US010472223B2

(12) United States Patent
Moon

(10) Patent No.: US 10,472,223 B2
(45) Date of Patent: Nov. 12, 2019

(54) INDUCTION HEATER AND WATER DISPENSER

(71) Applicant: LG ELECTRONICS INC., Seoul (KR)

(72) Inventor: Jungmin Moon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 242 days.

(21) Appl. No.: 15/241,164

(22) Filed: Aug. 19, 2016

(65) Prior Publication Data

US 2017/0050835 A1 Feb. 23, 2017

(30) Foreign Application Priority Data

Aug. 21, 2015 (KR) ..... 10-2015-0118214

(51) Int. Cl.
*H05B 6/10* (2006.01)
*B67D 1/08* (2006.01)

(52) U.S. Cl.
CPC ..... *B67D 1/0895* (2013.01); *H05B 6/108* (2013.01)

(58) Field of Classification Search
CPC .. B67D 1/0004; B67D 1/0014; B67D 1/0859; B67D 1/0864; B67D 1/0884; B67D 1/0888; B67D 1/0895; B67D 1/125; B67D 1/1279; H05B 6/02; H05B 6/06; H05B 6/10; H05B 6/108
USPC ..... 219/628, 629, 630
See application file for complete search history.

(56) References Cited

U.S. PATENT DOCUMENTS 5,334,819 A * 8/1994 Lin ..... F24H 1/121 219/628
2012/0138598 A1 6/2012 Akel

FOREIGN PATENT DOCUMENTS

| | | | |
|---|---|---|---|
| CN | 2711620 | | 7/2005 |
| CN | 201637067 | | 11/2010 |
| CN | 201637067 U | * | 11/2010 |
| CN | 204421319 | | 6/2015 |
| CN | 204421319 U | * | 6/2015 |
| KR | 10-1994-0002080 | | 2/1994 |
| KR | 10-2011-0096868 | | 8/2011 |
| KR | 20-2011-0010297 | | 11/2011 |
| KR | 10-2013-0000143 | | 1/2013 |
| KR | 10-2014-0057184 | | 5/2014 |
| KR | 2014-0057184 A | * | 5/2014 |

(Continued)

OTHER PUBLICATIONS

Korean Office Action dated Mar. 7, 2017 issued in Application No. 10-2016-0103693.

(Continued)

*Primary Examiner* — Hung D Nguyen
(74) *Attorney, Agent, or Firm* — KED & Associates, LLP

(57) ABSTRACT

An induction heater and a water dispenser having an induction heater are provided. The induction heater may include a hot water tank assembly formed by coupling edges of a first cover and a second cover to each other and provided with an inner space to heat liquid. The first cover may be configured to have a flat plate shape and to be heated by a working coil. The second cover may include a base configured to face the first cover and separated from the first cover, and a welding portion formed by welding with the first cover and provided on a protruding surface that protrudes from the base toward the first cover.

35 Claims, 15 Drawing Sheets

(56) References Cited

FOREIGN PATENT DOCUMENTS

WO WO 2013/082781 6/2013

OTHER PUBLICATIONS

International Search Report dated Nov. 23, 2016 issued in Application No. PCT/KR2016/008974.
Chinese Office Action dated Nov. 14, 2018 issued in Application No. 201610693683.2 (with English Translation).

* cited by examiner

INDUCTION HEATER AND WATER DISPENSER

CROSS-REFERENCE TO RELATED APPLICATIONS

This application claims priority under 35 U.S.C. § 119(a) to Korean Application No. 10-2015-0118214, filed on Aug. 21, 2015, whose entire disclosure is incorporated herein by reference.

BACKGROUND

1. Field

Embodiments relate to an induction heater and a water dispenser having an induction heater.

2. Background

A water dispenser may be a water purifier, which may be an apparatus that filters out various ingredients or particles contained in raw water, such as, e.g., tap water or underground water, via several filters installed within a main body and converts raw water to safe and sanitary drinking water. The water dispenser or water purifier may include, for example, a cold water passage, a hot water passage, and/or a purified water passage, and may control a flow of water with a mechanical or electronic valve so as to supply water that has passed through the filters to a water outlet portion.

Induction heating heats objects using electromagnetic induction. When a current is supplied to a coil, an eddy current may be generated on an object to be heated, and Joule heat generated by a resistance of a metal may increase a temperature of the object. An induction heating apparatus may include one or more combinations of magnets and coils.

Demand for a tank type water dispenser, for example, as a water purifier or in a refrigerator, has increased. The tank type water dispenser may be a water dispenser in which raw water has been filtered and stored in a water tank and then the filtered water or purified water stored in the water tank may be provided when a user manipulates an outlet of the tank type water dispenser. A direct flow type water dispenser may be a water dispenser in which a water tank is not provided therein such that raw water may be filtered and the filtered or purified water may be provided directly to a user when the user manipulates an outlet of the direct flow type water dispenser. The direct flow type water dispenser may be capable of supplying more sanitary water and saving more water than the tank type water dispenser.

Furthermore, demand for smaller sized water dispensers have increased to efficiently and effectively fit within limited spaces. A water dispenser that may supply hot water may also employ an induction heating method to quickly generate hot water as well as not occupy a large amount of space to keep pace with trends in smaller water dispenser sizes and direct flow type water dispenser preferences. However, deforming of an induction heater employed in a water dispenser may occur due to pressure increase during operation, and insufficiently heating may also occur.

BRIEF DESCRIPTION OF THE DRAWINGS

The embodiments will be described in detail with reference to the following drawings in which like reference numerals refer to like elements wherein.

DETAILED DESCRIPTION

Figure 1:
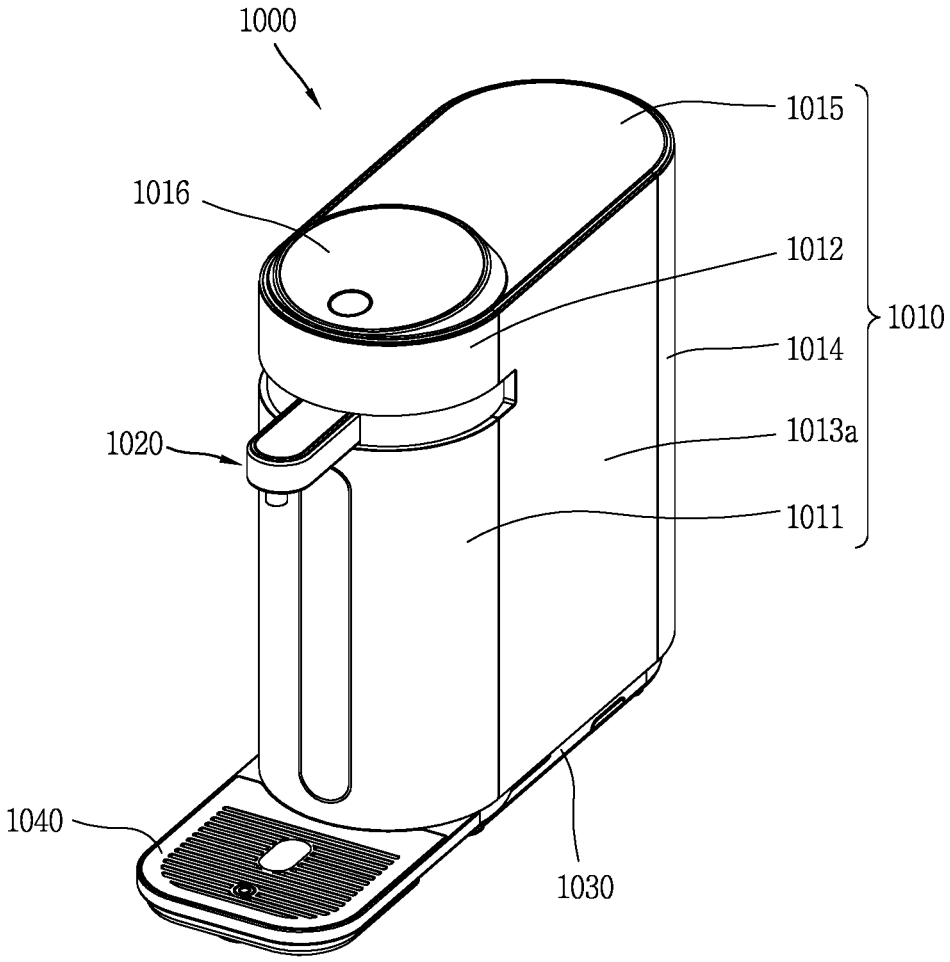
FIG. 1 is a conceptual view of an outer appearance of a water dispenser according to an embodiment.

Referring to FIG. 1, a water dispenser 1000 according to an embodiment disclosed herein may include a cover or case 1010, an outlet 1020, a base 1030, and a tray 1040. The cover 1010 may form an outer appearance of the water dispenser 1000. Components that filter raw water may be installed within the cover 1010. The cover 1010 may surround and protect the components. The cover 1010 may be a case or housing configured to form an outer appearance of the water dispenser 1000 and surround components that filter raw water. The cover 1010 may be provided as a single component, but may also be provided as a combination of several components. For example, as shown in FIG. 1, the cover 1010 may include a front cover 1011, a rear cover 1014, a side panel 1013*a*, an upper cover 1012 and a top cover 1015.

The front cover 1011 may be provided at a front side of the water dispenser 1000. The rear cover 1014 may be provided at a rear side of the water dispenser 1000. The front side and rear side of the water dispenser 1000 may be set based on a direction in which the outlet 1020 may be viewed in a forward direction along a user's line of sight. However, the front side and rear side of the water dispenser 1000 may not be absolute and may vary according to a method of describing the water dispenser 1000. Furthermore, in FIG. 1, the front cover 1011 and rear cover 1014 may have a curved surface, but the embodiments are not limited thereto.

The side panels 1013*a* may be provided on a left side and a right side of the water dispenser 1000, respectively. The side panel 1013*a* may be provided between the front cover 1011 and the rear cover 1014. The side panel 1013*a* may be coupled to the front cover 1011 and the rear cover 1014, respectively. The side panel 1013*a* may substantially form a side surface of the water dispenser 1000.

The upper cover 1012 may be provided at the front side of the water dispenser 1000. The upper cover 1012 may be installed at a higher position than that of the front cover 1011. The outlet 1020 may be exposed in a space between the upper cover 1012 and the front cover 1011. The upper cover 1012 may form an outer appearance of a front surface of the water dispenser 1000 along with the front cover 1011.

The top cover 1015 may form an upper surface of the water dispenser 1000. The top cover 1015 may be formed with an input/output portion 1016. The input/output portion 1016 may include an input portion and an output portion. The input portion may be configured to receive a user's control command. A method of receiving a user's control command at the input portion may include, for example, a touch or a physical pressure. The output portion may be configured to provide status information of the water dispenser 1000 to the user in an audiovisual manner.

The outlet 1020 may provide water or purified water to a user based on the user's control command. The outlet 1020 may protrude from the water dispenser 1000 to supply water. For example, in the water dispenser 1000 configured to provide cold water at a temperature lower than an ambient temperature and hot water at a temperature higher than the ambient temperature, at least one of hot water, cold water, and purified water at the ambient temperature may be provided to a user through a control command from the user.

The outlet 1020 may be configured to be rotatable by the user. The outlet 1020 may be rotated within a rotatable range between the front cover 1011 and the upper cover 1012. The rotation of the outlet 1020 may be carried out by a force physically applied to the outlet 1020 by the user. The rotation of the outlet 1020 may be carried out based on a control command applied to the input/output portion 1016 by the user. A configuration such that the outlet 1020 may be rotatable may be installed within the water dispenser 1000, for example, installed in a region hidden by the upper cover 1012. The input/output portion 1016 may be also rotate along with the outlet 1020 during the rotation of the outlet 1020.

The base 1030 forms a bottom of the water dispenser 1000. Components within the water dispenser 1000 may be supported by the base 1030. When the water dispenser 1000 is mounted on, for example, a floor or a shelf, the base 1030 may face the floor or the shelf. Accordingly, when the water dispenser 1000 is mounted or placed on the floor or shelf, the base 1030 may not be exposed to an outside.

The tray 1040 may face the outlet 1020. Based on where the water dispenser 1000 is installed, the tray 1040 may support a container to store or collect water provided from the outlet 1020. The tray 1040 may accommodate or collect residual water that may fall from the outlet 1020. When the tray 1040 receives and collects residual water that falls from the outlet 1020, it may prevent contamination of residual water around the water dispenser 1000. As the tray 1040 may receive or collect residual water falling from the outlet 1020, the tray 1040 may also rotate along with the outlet 1020. The input/output portion 1016 and tray 1040 may rotate in a same direction as a direction of rotation of the outlet 1020.

Figure 2:
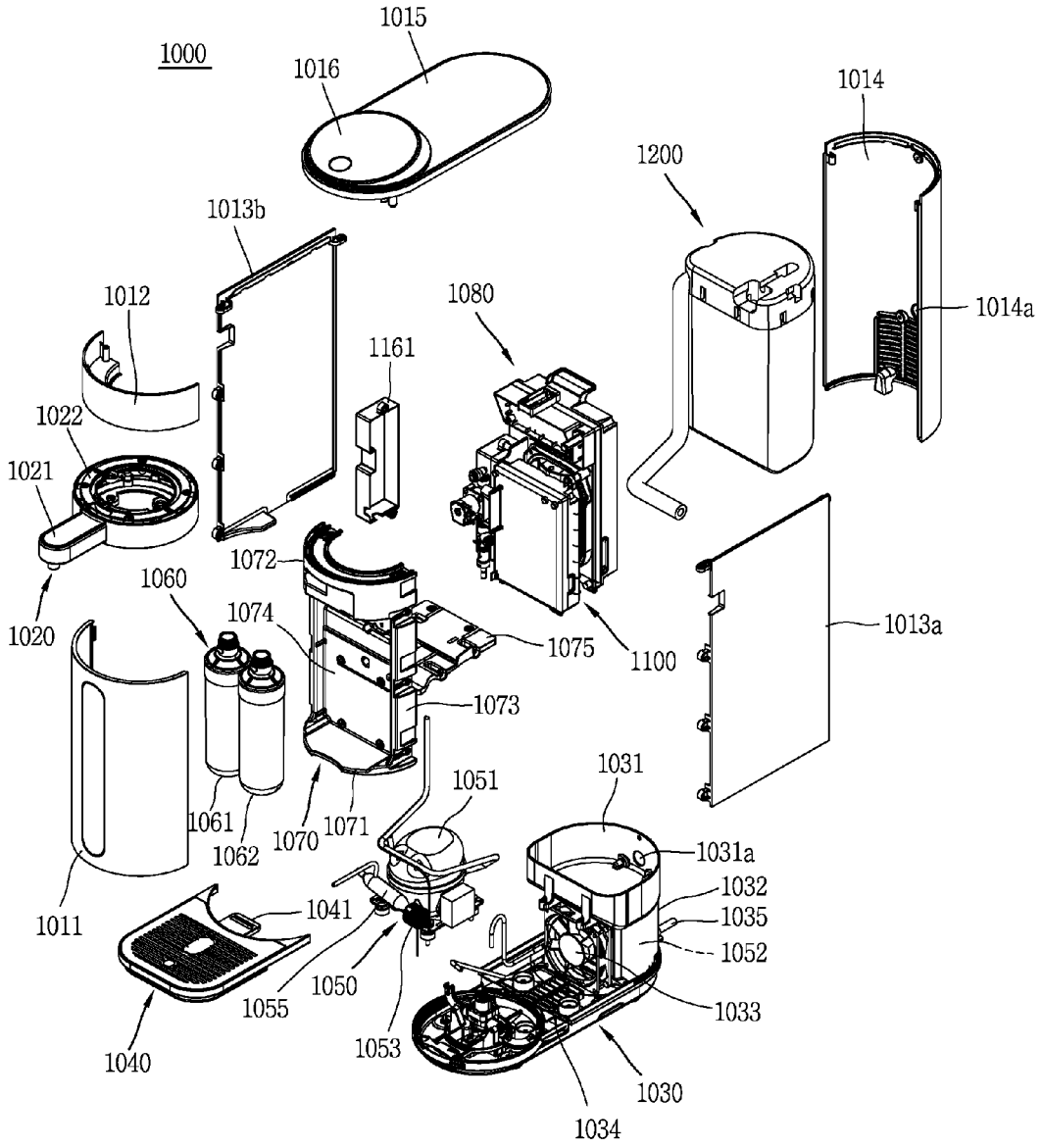
FIG. 2 is an exploded perspective view of internal components of a water dispenser according to an embodiment.

Referring to FIG. 2, a filter module 1060 may be installed at an inside of the front cover 1011. The filter module 1060 may filter raw water to produce purified water. As purified water may be difficult to produce with only one filter, the filter module 1060 may include a plurality of unit filters 1061, 1062. The unit filters 1061, 1062 may include a prefilter, such as, e.g., carbon black, absorption filter, and an ultra filtration filter, for example, a high efficiency particulate air (HEPA) filter or UF filter. Two unit filters 1061, 1062 may be provided, but a number of unit filters 1061, 1062 may be increased as needed. The plurality of unit filters 1061, 1062 may be connected according to a preset order. The preset order may be an appropriate order for filtering water. Raw water may include various foreign substances, and ultra filtration filters, such as a HEPA filter or UF filter, may need to be protected from large-sized particles in the water such as hair or dust. Accordingly, a prefilter may be installed at an upstream side of the ultra filtration filters, and an outlet of the prefilter may be connected to an inlet of the ultra filtration filter. The prefilter may remove large-sized particles from water. When the prefilter is provided at an upstream side of the ultra filtration filter to first remove large-sized particles contained in raw water, water that does not contain large-sized particles may be supplied to the ultra filtration filter. The raw water that has passed through the prefilter may be subsequently filtered by the HEPA filter or UF filter.

The purified water produced by the filter module 1060 may be immediately provided to a user through the outlet 1020, and a temperature of the purified water provided to the user may correspond to an ambient temperature. The purified water produced by the filter module 1060 may become hot water via an induction heater 1100 and become cold water by a cold water tank assembly 1200.

A filter bracket 1070 may be used to fix the unit filters 1061, 1062 of the filter module 1060 and fix a water outlet passage or valve for purified water or cold water. A lower end 1071 of the filter bracket 1070 may be coupled to the tray 1040. The lower end 1071 of the filter bracket 1070 may accommodate a protrusion 1041 of the tray 1040. As the protrusion 1041 of the tray 1040 is inserted into the lower end 1071 of the filter bracket 1070, the filter bracket 1070 and the tray 1040 may be coupled. The lower end 1071 of the filter bracket 1070 and the tray 1040 may each have a curved surface that corresponds to each other. The lower end 1071 of the filter bracket 1070 may be independently rotated from a remaining portion thereof.

An upper end 1072 of the filter bracket 1070 may support the outlet 1020. The upper end 1072 of the filter bracket 1070 may form a rotation path of the outlet 1020. The outlet 1020 may be divided into an outlet cork portion 1021 that protrudes out from the water dispenser 1000 and a rotation portion 1022 provided within the water dispenser 1000. The rotation portion 1022 may be formed in a circular shape. The rotation portion 1022 may be mounted on the upper end 1072 of the filter bracket 1070. The upper end 1072 of the filter bracket 1070 may be independently rotated from a remaining portion thereof. The outlet 1020 mounted on the upper end 1072 of the filter bracket 1070 may be configured to rotate relative to the filter bracket 1070.

The lower end 1071 and upper end 1072 of the filter bracket 1070 may be connected to each other by a connecting portion 1073. The lower end 1071 and upper end 1072 of the filter bracket 1070 connected to each other by the connecting portion 1073 may be rotated together in a same direction. If a user rotates the outlet 1020, the upper end 1072, the connecting portion 1073, the lower end 1071, and the tray 1040 of the filter bracket 1070 may be rotated along with the outlet 1020.

A filter installation region 1074 configured to accommodate the unit filters 1061, 1062 of the filter module 1060 may be formed between the lower end 1071 and upper end 1072 of the filter bracket 1070. The filter installation region 1074 may provide an installation space for the unit filters 1061, 1062. A support fixture 1075 protruded toward a rear side of the water dispenser 1000 may be formed at an opposite side to the filter installation region 1074. The support fixture 1075 may support a controller 1080 and the induction heater 1100. The controller 1080 and the induction heater 1100 may be mounted or provided on the support fixture 1075. The support fixture 1075 may suppress heat from the induction heater 1100 from being conducted to a compressor 1051 or other components.

The controller 1080 may be used for overall control of the water dispenser 1000. Various printed circuit boards to control operation of the water dispenser 1000 may be integrated into the controller 1080. The controller 1080 may be operated based on a control command applied through the input portion of the input/output portion 1016 or operated according to a preset algorithm.

The induction heater 1100 may heat water from the filter module 1060 to produce hot water. The induction heater 1100 may include components capable of heating water through induction heating. The induction heater 1100 may receive water or purified water from the filter module 1060, and hot water produced from the induction heater 1100 may be discharged through the outlet 1020. The induction heater 1100 may include a printed circuit board that controls hot water production. A protection cover 1161 to prevent water from being infiltrated into the printed circuit board and protect the printed circuit board may be coupled to one side of the induction heater 1100.

The refrigerating cycle device 1050 may produce cold water. The refrigerating cycle device 1050 may be a set of devices in which processes of compression-condensation-expansion-evaporation of refrigerant may be carried out. In order to produce cold water from the cold water tank assembly 1200, the refrigerating cycle device 1050 may be operated first to make cool water at low temperatures to be filled within the cold water tank assembly 1200.

The compressor 1051 may compress refrigerant. The compressor 1051 may be connected to a condenser 1052 by a refrigerant passage, and refrigerant compressed in the compressor 1051 may flow to the condenser 1052 through the refrigerant passage. The compressor 1051 may be provided below the support fixture 1075 and may be installed to be supported by the base 1030. The condenser 1052 may condense refrigerant. The refrigerant compressed in the compressor 1051 may flow into the condenser 1052 through the refrigerant passage and may be condensed by the condenser 1052. The refrigerant condensed by the condenser 1052 may flow into a dryer 1055 through the refrigerant passage.

The dryer 1055 may remove moisture from the refrigerant. In order to enhance efficiency of the refrigerating cycle device 1050, moisture may be removed in advance from the refrigerant introduced into a capillary 1053. The dryer 1055 may be provided between the condenser 1052 and the capillary 1053 to remove moisture from the refrigerant, thereby enhancing efficiency of the refrigerating cycle device 1050. The capillary 1053 may expand refrigerant, and according to design, a throttle valve may constitute an expansion device instead of the capillary 1053. The capillary 1053 may be rolled in a coil-like shape to provide sufficient length within a small space.

An evaporator may evaporate the refrigerant, and may be provided at an inner side of the cold water tank assembly 1200. Cool water filled at an inner side of the cold water tank assembly 1200 and the refrigerant in the refrigerating cycle device 1050 may exchange heat with each other via the evaporator. The cool water may be maintained at low temperatures through heat exchange with the refrigerant. The refrigerant heated by exchanging heat with the cool water in the evaporator may be provided again to the compressor 1051 along the refrigerant passage to continuously circulate the refrigerating cycle device 1050.

The base 1030 may support the compressor 1051, the front cover 1011, the rear cover 1014, two side panels 1013*a*, 1013*b*, the filter bracket 1070, the condenser 1052, and a fan 1033. The base 1030 may have a high rigidity to support components. The condenser 1052 and the fan 1033 may be installed at a rear side of the water dispenser 1000, and a circulation of air may be continuously required for heat dissipation of the condenser 1052. The base 1030 may have an air circulation intake port 1034 at a bottom to dissipate the condenser 1052. Air taken in through the air circulation intake port 1034 may be cooled while moving toward the condenser 1052 by the fan 1033. A duct 1032 that surrounds the fan 1033 and the condenser 1052 may be fixed to the base 1030 to enhance dissipation efficiency of the condenser 1052.

A drain 1035 may be provided at a rear side of the duct 1032. The drain 1035 may be exposed to an outer side of the water dispenser 1000 to form a drain passage. Since internal passages of the water dispenser 1000 through which water flows may all be configured to pass therethrough, fluids in the internal passages may be all exhausted through the drain 1035.

A stand 1031 that supports the cold water tank assembly 1200 may be provided at an upper portion of the condenser 1052. The stand 1031 and the rear cover 1014 may be provided with holes 1031*a*, 1014*a*, respectively, at corresponding positions. The two holes 1031*a*, 1041*a* may drain cool water filled in the cold water tank assembly 1200. The cold water tank assembly 1200 may accommodate cool water within the cold water tank assembly 1200. The cold water tank assembly 1200 may receive water or purified water produced from the filter module 1060. For example, in a direct flow type water dispenser, the cold water tank assembly 1200 may directly receive purified water from the filter module 1060.

A temperature of cool water filled in the cold water tank assembly 1200 may be decreased by the operation of the refrigerating cycle device 1050. The cold water tank assembly 1200 may cool purified water with cool water to form cold water. Since the cool water is stored in the cold water tank assembly 1200 but not circulated, contamination of the cool water may occur when a long period of time has passed. For sanitary reasons, cool water stored in the cold water tank assembly 1200 may be periodically discharged, and new cool water may be filled into the cold water tank assembly 1200.

The induction heater 1100 may include a set of components to receive purified water from the filter module 1060 to produce hot water. In a direct flow type water dispenser 1000 that is not provided with an additional water tank, the induction heater 1100 may directly receive purified water from the filter module 1060. The induction heater 1100 may include an induction heating printed circuit board 1110, an induction heating printed circuit board cover 1121, 1122, a hot water tank assembly 1130, a working coil assembly 1140 and a shield plate 1150.

The induction heating printed circuit board 1110 may control an induction heating operation of the working coil assembly 1140. The working coil assembly 1140 may be provided with a working coil 1144, and the working coil 1144 may be electrically connected to the induction heating printed circuit board 1110 and controlled by the induction heating printed circuit board 1110. For example, when a user manipulates the outlet 1020 of the water dispenser 1000 or enters a control command to discharge out hot water, purified water produced from the filter module 1060 may be supplied to the hot water tank assembly 1130. The induction heating printed circuit board 1110 may control the working coil 1144 to flow a current therethrough. The hot water tank assembly 1130 may be induction heated by a current supplied to the working coil 1144 to dissipate heat. Purified water may be heated while passing through the hot water tank assembly 1130 to become hot water.

The induction heating printed circuit board cover 1121, 1122 may surround the induction heating printed circuit board 1110. The induction heating printed circuit board cover 1121, 1122 may include a first induction heating cover 1121 and a second induction heating cover 1122. The first induction heating cover 1121 and second induction heating cover 1122 may be coupled to each other at edges thereof. The induction heating printed circuit board 1110 may be provided in an inner space formed by the first induction heating cover 1121 and second induction heating cover 1122. A sealing member configured to prevent the infiltration of water may be coupled to the edges of the first induction heating cover 1121 and the second induction heating cover 1122. The first induction heating cover 1121 and second induction heating cover 1122 may be a flame-retardant material to prevent the damage of the induction heating printed circuit board 1110 due to fire.

The hot water tank assembly 1130 may heat purified water to produce hot water. The hot water tank assembly 1130 may receive induction heat according to an effect of magnetic field lines formed by the working coil 1144. Water may be instantly heated to become hot water while passing through the inner space of the hot water tank assembly 1130, which may be configured to maintain an airtight sealing. A thickness as well as a length or width of the hot water tank assembly 1130 may be reduced compared to related art so as to correspond to and provide smaller sized water dispensers. However, the hot water tank assembly 1130 formed in a flat plate shape may have several problems.

For example, the hot water tank assembly 1130 may become deformed. When liquid is heated in the inner space of the hot water tank assembly 1130, the liquid is expanded. Expansion of liquid may cause pressure of the inner space to abruptly increase. The abrupt increase of pressure may cause the deformation of the hot water tank assembly 1130. When liquid is heated using a large-sized hot water tank assembly, a time period during which liquid stays within the hot water tank assembly may be sufficient, and thus the liquid may be sufficiently heated. However, the small-sized hot water tank assembly 1130 may have insufficient time in order to heat the liquid, and thus, the liquid may be insufficiently heated. Though the above problems may not be directly caused by miniaturization of the hot water tank assembly 1130, severity of these problems may be further increased as the hot water tank assembly 1130 becomes smaller. The hot water tank assembly 1130 according to embodiments disclosed herein may have a structure capable of reducing these problems.

The working coil 1144 may form magnetic field lines causing the heat dissipation of the hot water tank assembly 1130. The working coil assembly 1140 having the working coil 1144 may be provided at one side of the hot water tank assembly 1130. When a current is supplied to the working coil 1144, magnetic field lines may be formed from the working coil 1144. The magnetic field lines may produce an effect to implement induction heating and cause heating in the hot water tank assembly 1130.

The shield plate 1150 the hot water tank assembly 1130 provided at one side of the working coil assembly 1140. The shield plate 1150 may be provided at an opposite side of the hot water tank assembly 1130 than the working coil assembly 1140. The shield plate 1150 may prevent magnetic field lines generated from the working coil assembly 1140 from being radiated into a remaining region excluding the hot water tank assembly 1130. The shield plate 1150 may be formed of aluminium or other materials to change the flow of magnetic field lines.

The controller 1080 may include a control printed circuit board 1082, a noise printed circuit board 1083, a near field communication (NFC) printed circuit board 1084, a buzzer 1085, a main printed circuit board 1086, and a main printed circuit board cover 1087, 1088. The control printed circuit board 1082 may be a sub-configuration of a display printed circuit board. The control printed circuit board 1082 may not be an essential configuration that drives a water dispenser such as the water dispenser 1000, but may perform a secondary role as a display printed circuit board.

The noise printed circuit board 1083 may provide power to the induction heating printed circuit board 1110. Since an output voltage for induction heating may be very high, sufficient power may need to be supplied. While the noise printed circuit board 1083 may not be essential to drive a water dispenser, the water dispenser such as the water dispenser 1000 may have the noise printed circuit board 1083 to prepare for when power required for induction heating is not sufficiently supplied. The noise printed circuit board 1083 may supply additional power to the induction heating printed circuit board 1110 to satisfy an output voltage for induction heating. The noise printed circuit board 1083 may provide secondary power to other components as well as the induction heating printed circuit board 1110.

The buzzer 1085 may output an audio sound to provide accurate failure information to a user when a failure has occurred in the water dispenser 1000. The buzzer 1085 may output a specific audio sound of a preset code to correspond to a type of failure.

The NFC printed circuit board 1084 may send and receive data to and from a communication device. The NFC printed circuit board 1084 may provide status information of a water dispenser to a personal communication device paired with the water dispenser, and receive a user's control command from the personal communication device.

The main printed circuit board 1086 may control an overall operation of a water dispenser such as the water dispenser 1000. The operation of the input/output portion 1016 or the compressor 1051 may be also controlled by the main printed circuit board 1086. When power is insufficient, the main printed circuit board 1086 may receive power through the noise printed circuit board 1083.

The main printed circuit board cover 1087, 1088 may surround the main printed circuit board 1086. The main printed circuit board cover 1087, 1088 may include a first main cover 1087 and a second main cover 1088. The main printed circuit board 1086 may be provided in an inner space formed by the first main cover 1087 and second main cover 1088. The first main cover 1087 and second main cover 1088 may be coupled to each other at their edges. A sealing member to prevent infiltration of water may be installed on the first main cover 1087 and second main cover 1088. The first main cover 1087 and second main cover 1088 may be preferably formed of a flame-retardant material to prevent the damage of the main printed circuit board 1086 due to fire.

Figure 4A:
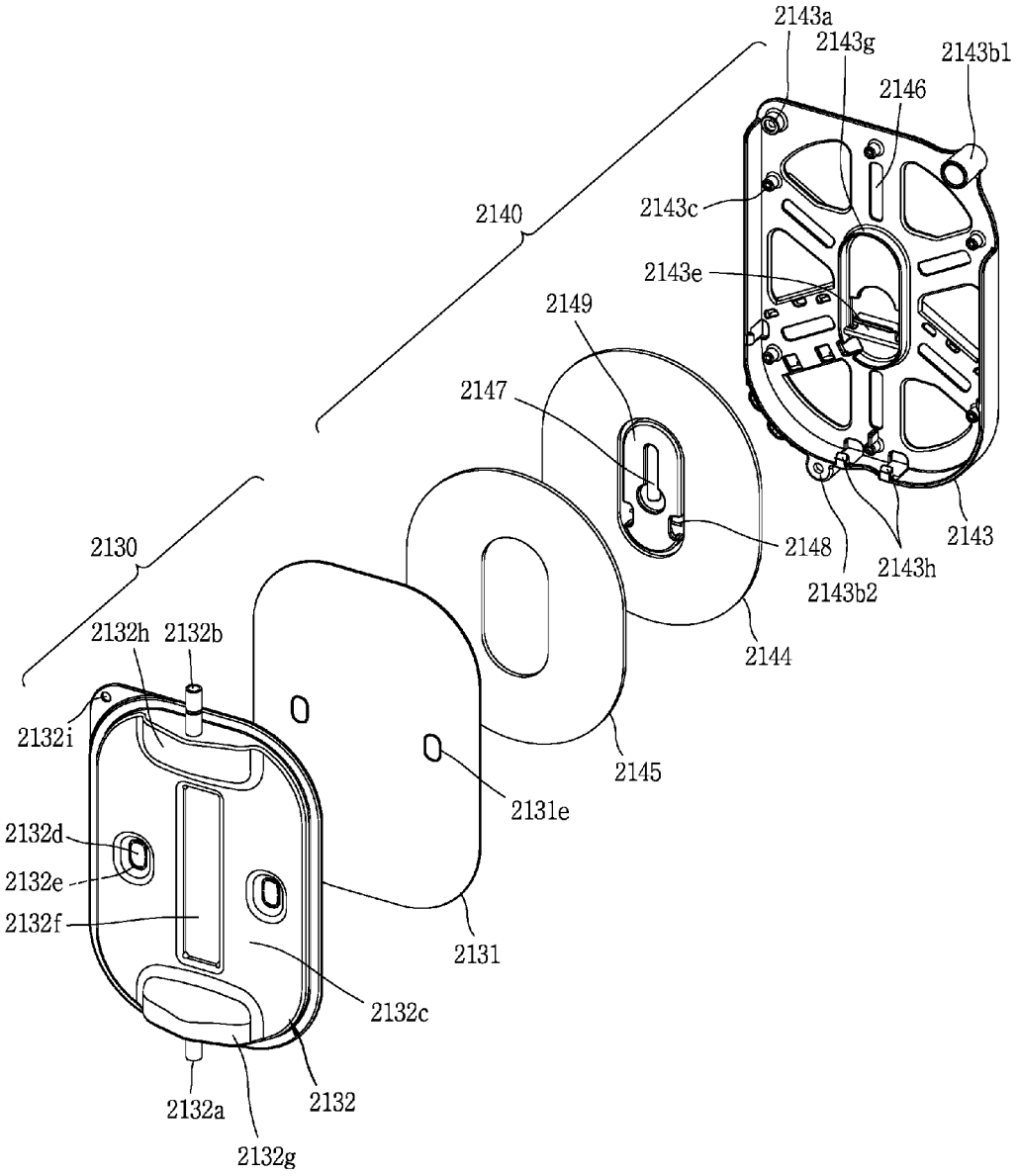
FIG. 4A and FIG. 4B are exploded perspective views of a hot water tank assembly according to an embodiment viewed from different directions.
Figure 4B:
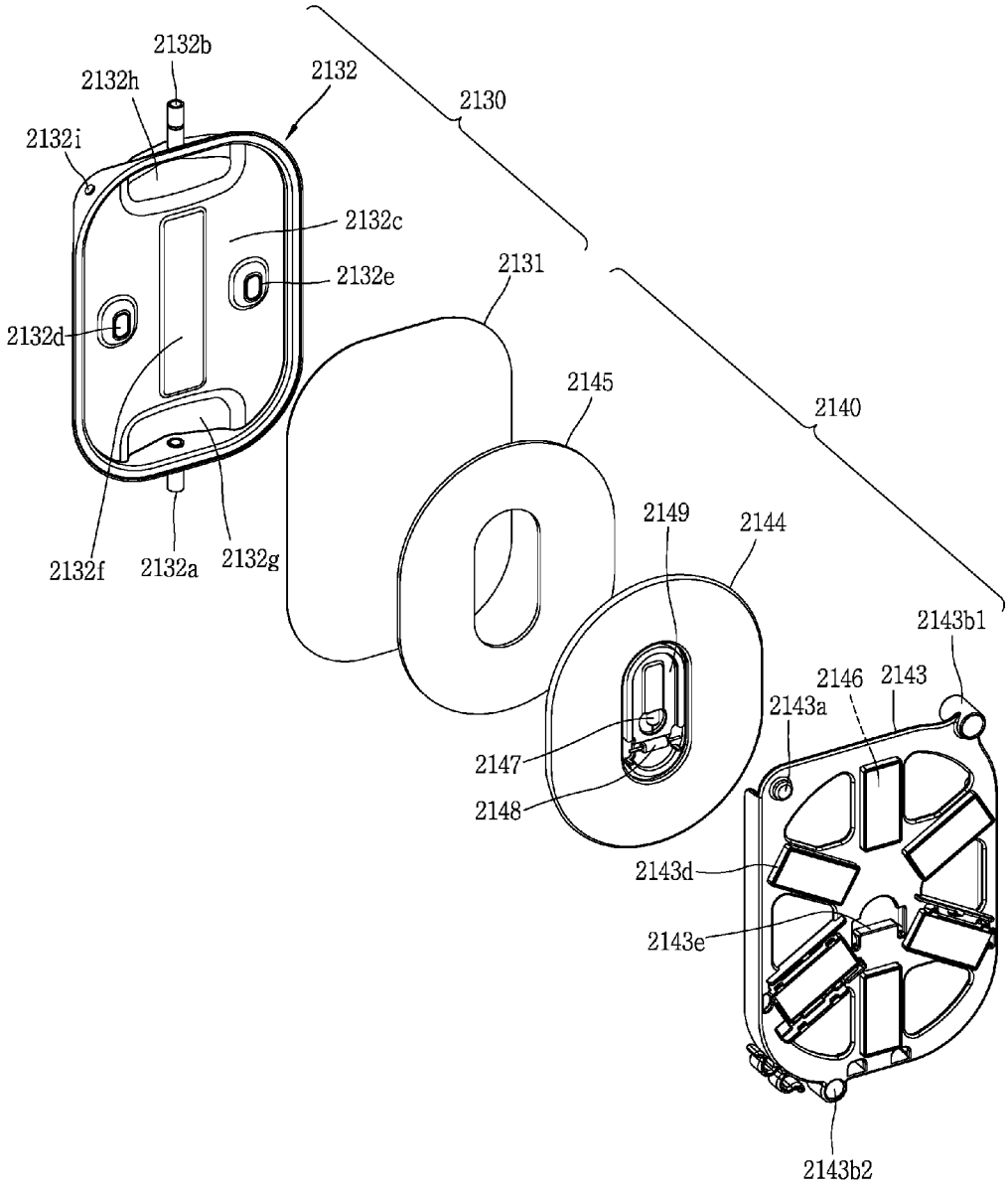

FIG. 4A and FIG. 4B are views of an embodiment with a hot water tank assembly 2130 and a working coil assembly 2140. The hot water tank assembly 2130 may be formed by coupling edges of a first cover 2131 and a second cover 2132 to each other. An edge of the first cover 2131 and an edge of the second cover 2132 may be coupled to each other by welding or the like to maintain airtight sealing. The hot water tank assembly 2130 may be provided with an inner space to heat liquid. The inner space may be formed by a coupling between the first cover 2131 and the second cover 2132.

The hot water tank assembly 2130 may include an water inlet pipe 2132*a* and an water outlet pipe 2132*b*. Referring to FIG. 4A and FIG. 4B, the water inlet pipe 2132*a* and water outlet pipe 2132*b* may be formed on the second cover 2132. The water inlet pipe 2132*a* may correspond to a passage into which liquid to be heated may be introduced. The water outlet pipe 2132*b* may correspond to a passage into which liquid that has been heated is discharged. The water inlet pipe 2132*a* and water outlet pipe 2132*b* may be formed at opposite sides to each other. The water inlet pipe 2132*a* and water outlet pipe 2132*b* may be extended in directions away from each other.

The first cover 2131 may receive induction heating by the working coil 2144, and thus, a distance between the first cover 2131 and working coil 2144 may need to be constantly maintained to accurately control an induction heating output. If the working coil 2144 gets out of a reference position, it may be difficult to accurately control the induction heating output. The reference position may be a position of the working coil 2144 at which an operation of allowing the first cover 2131 to implement induction heating by the working coil 2144 may be accurately controlled. A distance between the first cover 2131 and the working coil 2144 may be maintained by a gap spacer 2145. When one portion of the first cover 2131 is too far from or too close to the working coil 2144 compared to another portion thereof, sufficient heat may not be generated from the one portion. Accordingly, the first cover 2131 may have a flat plate shape to uniformly locate the entire portion of the first cover 2131 at a proper distance from the working coil 2144.

The first cover 2131 may be formed of an appropriate material to generate heat. The first cover 2131 may be formed of a stainless material, and may be formed of 4-series stainless steel. The first cover 2131 may be formed of an STS (Stainless Steel, Korean Industrial Standard) 439 material. The STS 439 may have an enhanced corrosion resistance, which may be a property where corrosion due to contact with water is suppressed, compared to STS 430. The first cover 2131 may have a thickness of about 0.8 mm.

The second cover 2132 may have a low relevance compared to that of the first cover 2131 since the second cover 2132 may be provided at an opposite side to the working coil 2144 and may be less affected by magnetic field lines. Accordingly, the second cover 2132 may be formed of a material having more corrosion resistance than heat generation characteristics. The second cover 2132 may be formed of a stainless material and may be formed of a 3-series stainless material. The second cover 2132 may be formed of an STS 304 material. The supporting member 304 may have enhanced corrosion resistance compared to the STS 439. The second cover 2132 may have a thickness of about 1.0 mm.

The second cover 2132 may include a base surface 2132*c*, a protruding surface 2132*d*, a welding portion 2132*e*, a protrusion portion 2132*f*. The base surface 2132*c*, protruding surface 2132*d* and protrusion portion 2132*f* may be integrally formed via pressing processing. When press processing is partially carried out on the second cover 2132 having the base surface 2132*c*, the protruding surface 2132*d* and protrusion portion 2132*f* may be formed on the second cover 2132. Being integrally formed may not denote being formed as separate constituent elements but denotes being formed as one constituent element, and the base surface 2132*c*, protruding surface 2132*d* and protrusion portion 2132*f* should be understood to be referred to as to distinguish any one portion thereof from another portion thereof. The base surface 2132*c*, protruding surface 2132*d*, and protrusion portion 2132*f* may designate different portions of the second cover 2132.

The base surface 2132*c* may face the first cover 2131 at a position separated from the first cover 2131. The hot water tank assembly 2130 has been described to include an inner space for heating liquid, and the base surface 2132*c* may be separated from the first cover 2131 to form the inner space.

The protruding surface 2132*d* may be protruded toward the first cover 2131 from the base surface 2132*c*. The protruding surface 2132*d* may be closely adhered to the first cover 2131. A circumference of the protruding surface 2132*d* may connect the base surface 2132*c* and protruding surface 2132*d* to each other. When press processing is carried out to form the protruding surface 2132*d*, a circumference connected between the base surface 2132*c* and the protruding surface 2132*d* may be naturally formed. The circumference of the protruding surface 2132*d* may be formed in an inclined manner.

The welding portion 2131*e*, 2132*e* may be formed by welding the first cover 2131 and second cover 2132. For example, the welding portion 2131*e*, 2132*e* may be formed by welding of the first cover 2131 and protruding surface 2132*d*. The base surface 2132*c* may be separated from the first cover 2131 to form an inner space of the hot water tank assembly 2130, and thus, the base surface 2132*c* may not be welded to the first cover 2131. Since the circumference of the protruding surface 2132*d* is away from the first cover 2131 and closer to the base surface 2132*c*, it may be difficult to be welded to the first cover 2131. The protruding surface 2132*d* may be protruded to be closely adhered to the first cover 2131, and it may be easily welded to the first cover 2131.

The welding portion 2131*e*, 2132*e* may prevent the deformation of the first cover 2131 and second cover 2132. When the temperature of liquid is increased within the hot water tank assembly 2130 by operation of the induction heater 1100*a*, the liquid may be gradually expanded and a pressure within the hot water tank assembly 2130 may be gradually increased. When water is evaporated to become steam, the volume may increase by about 1700 times, and a pressure within the hot water tank assembly 2130 may increase to a very high level during a hot water generation process. The rapidly increased internal pressure of the hot water tank assembly 2130 may cause the deformation of the first cover 2131 and second cover 2132.

The first cover 2131 may have a flat plate shape to carry out induction heating as described above, such that there may be a restriction in having such a structure that prevents deformation due to a pressure increase. The welding portion 2132*e* may be introduced to prevent the deformation of the first cover 2131 in spite of this restriction.

Welding may be an operation of locally applying heat to a position desired to melt a part of metallic material and rearrange atomic bonds to adhere two metallic materials to each other. Adhesion by welding may have a very strong binding force due to rearrangement of atomic bonds. The welding portion 2131*e*, 2132*e* may be formed by welding of the protruding surface 2132*d* and first cover 2131, and thus it may be described that the first cover 2131 has the welding portion 2131*e*, and also may be described that the second cover 2132 has the welding portion 2131*e*, 2132*e*, and may be described that the first cover 2131 and second cover 2132 have welding portions 2131*e*, 2132*e*.

The welding portion 2131*e*, 2132*e* may strongly couple the first cover 2131 to the second cover 2132, and the deformation of the first cover 2131 may be prevented even though an internal pressure of the hot water tank assembly 2130 is increased. The deformation of the second cover 2132 as well as the first cover 2131 may be prevented when coupling the first cover 2131 to the second cover 2132 each other.

At least one of the welding portions 2131*e*, 2132*e* may be formed at both sides of the protrusion portion 2132*f*, respectively. Both sides of the protrusion portion 2132*f* as shown in FIG. 4A and FIG. 4B may refer to left and right sides of the protrusion portion 2132*f*, but a location of the welding portion 2132*e* may not be limited to a specific location. The welding portion 2132*e* may be formed at a position that does not overlap with the temperature sensor 2147. An overlapping position may be a position in which the welding portion 2132*e* and temperature sensor 2147 may be projected onto a same region when the working coil assembly 2140 is viewed from a front side from the second cover 2132.

The temperature sensor 2147 may be provided at an opposite side to the second cover 2132 based on the first cover 2131. The temperature sensor 2147 may be configured to measure a temperature of liquid passing through the inner space of the hot water tank assembly 2130. When the temperature of liquid is measured by the temperature sensor 2147, the liquid may be at a position overlapping with the temperature sensor 2147. If the welding portion 2131*e*, 2132*e* is formed at a position overlapping with the temperature sensor 2147, the liquid may not be at a position overlapping with the temperature sensor 2147, and only the welding portion 2131*e*, 2132*e* may be provided at the position, and therefore, the temperature sensor 2147 may be unable to normally measure the temperature of liquid.

When the temperature sensor 2147 is provided at a position overlapping with a center of the second cover 2132 as shown in FIG. 4A and FIG. 4B, the welding portion 2131*e*, 2132*e* may be formed at remaining positions excluding the center of the second cover 2132. When the position of the temperature sensor 2147 is changed, the position of the welding portion 2131*e*, 2132*e* may be also changed to another position that does not overlap with the temperature sensor 2147.

The welding portion 2131*e*, 2132*e* may have a closed curve shape. If the welding portion 2131*e*, 2132*e* is formed in a shape having an end point such as a straight line or curved line, then pressure formed within the hot water tank assembly 2130 may be concentrated on the end point. Accordingly, separation of the first cover 2131 from the second cover 2132 may occur from the end point. When the welding portion 2131*e*, 2132*e* has a closed curve shape, pressure may be uniformly distributed on the closed curve shape without being concentrated on any one portion thereof. Accordingly, the welding portion 2131*e*, 2132*e* with a closed curve shape may reduce breakdown of the hot water tank assembly 2130. The closed curve may be a diagram with a same start point and end point when one point is taken on a straight line or curved line. For example, a polygon, a circle, or an ellipse may correspond to the closed curve, and the closed curve may not be formed only with a curved line but may be formed by a set of straight lines. Accordingly, the closed curve may be referred to as a closed diagram or a single closed curve.

The protrusion portion 2132*f* may protrude toward the first cover 2131 from the base surface 2132*c*. The protruding surface 2132*d* may be closely adhered to the first cover 2131, or the protrusion portion 2132*f* may be separated from the first cover 2131 without being closely adhered to the first cover 2131. The protrusion portion 2132*f* may be closer to the first cover 2131 than the base surface 2132*c*.

The protrusion portion 2132*f* may be extended toward the water inlet pipe 2132*a* and the water outlet pipe 2132*b* of the hot water tank assembly 2130. For example, when the water inlet pipe 2132*a* and water outlet pipe 2132*b* are provided at opposite sides based on a top-down direction of the hot water tank assembly 2130, the protrusion portion 2132*f* may be also extended in a top-down direction toward the water inlet pipe 2132*a* and the water outlet pipe 2132*b*. Rigidity of the second cover 2132 may be enhanced through the structure of the protrusion portion 2132*f* being protruded toward the first cover 2131 and extended toward the water inlet pipe 2132*a* and water outlet pipe 2132*b*.

The protrusion portion 2132*f* may be provided to prevent deformation of the second cover 2132 and to distribute flow of liquid or to control flow speed of liquid.

As described above, when an internal pressure of the hot water tank assembly 2130 increases, it may cause deformation of the second cover 2132 as well as the first cover 2131. The rigidity of the second cover 2132 may be enhanced through a structure in which the protrusion portion 2132*f* is extended in a protruded state, and the deformation of the second cover 2132 may be prevented by the protrusion portion 2132*f* even when the internal pressure of the hot water tank assembly 2130 increases. The second cover 2132 may be strongly coupled to the first cover 2131 by the welding portion 2131*e*, 2132*e*, and therefore, the deformation of the second cover 2132 may be prevented by an interaction between the welding portion 2131*e*, 2132*e* and the protrusion portion 2132*f*.

The protrusion portion 2132*f* may have a predetermined width in a direction that crosses an extension direction. For example, referring to FIG. 4A and FIG. 4B, the extension direction of the protrusion portion 2132*f* is a top-down direction toward the water inlet pipe 2132*a* and the water outlet pipe 2132*b*. The direction that crosses the extension direction may be a left-right direction. Since the protrusion portion 2132*f* has a predetermined width in the left-right direction, particles in liquid introduced through the water inlet pipe 2132*a* may collide with the protrusion portion 2132*f*. The colliding particles in liquid may be dispersed in all directions, and through such a mechanism, the protrusion portion 2132*f* may distribute a flow into various places within the hot water tank assembly 2130.

The protrusion portion 2132*f* may control a flow speed. The protrusion portion 2132 may form a flow resistance to reduce a flow speed of liquid. As particles in liquid introduced to the hot water tank assembly 2130 through the water inlet pipe 2132*a* collide with the protrusion portion 2132*f*, the particles may provide a resistance in flow. Accordingly, when particles in liquid collide with the protrusion portion 2132*f*, a flow speed of liquid may decrease to prevent the liquid from being excessively and rapidly discharged without being sufficiently heated within the hot water tank assembly 2130. The protrusion portion 2132*f* may control the flow speed to allow the liquid to sufficiently stay in the hot water tank assembly 2130. Accordingly, the liquid may be sufficiently heated within the hot water tank assembly 2130.

The protrusion portion 2132*f* may be formed by press processing. Since the protruding surface 2132*d* may also be formed by press processing, the protrusion portion 2132*f* and protruding surface 2132*d* may be formed at the same time by one-time press processing. A location of the protrusion portion 2132*f* is not limited. The protrusion portion 2132*f* may be formed at any position overlapping with the temperature sensor 2147. For example, the protrusion portion 2132*f* may be formed along a length direction at the center of the second cover 2132 as illustrated in FIG. 4A and FIG. 4B. A plurality of protrusion portions 2132*f* may be provided as needed.

The hot water tank assembly 2130 may include a flow dispersion portion 2132*g* and a flow joining portion 2132*h*. The flow dispersion portion 2132*g* and the flow joining portion 2132*h* may have substantially a same shape, but may not be necessarily limited thereto. The flow dispersion portion 2132*g* and the flow joining portion 2132*h* may be formed at opposite sides of the second cover 2132 to each other.

The flow dispersion portion 2132*g* may be connected to the water inlet pipe 2132*a* of the hot water tank assembly 2130 to disperse liquid introduced through the water inlet pipe 2132*a* to various places within the hot water tank assembly 2130 and control a flow speed of the liquid. When liquid introduced into the hot water tank assembly 2130 is not properly dispersed but concentrated only in a partial region, the liquid is not sufficiently heated in the partial region in which the liquid is concentrated, and loss of energy may occur in a region on which the liquid is not concentrated. Accordingly, dispersion of liquid by the flow dispersion portion 2132*g* may be required to sufficiently heat the liquid and save energy. When liquid excessively and rapidly passes through the hot water tank assembly 2130, the liquid may not be sufficiently heated. Accordingly, timing parameters to control a flow speed of the liquid introduced into the hot water tank assembly 2130 may need to be set to sufficiently heat the liquid within the hot water tank assembly 2130.

The flow dispersion portion 2132*g* may be formed to protude in a direction away from the first cover 2131 such that a distance between the flow dispersion portion 2132*g* and the first cover 2131 may be increased. Referring to FIG. 4B, the distance between the flow dispersion portion 2132*g* and the first cover 2131 may be larger than that between the base surface 2132*c* and the first cover 2131. Since a wide passage may be secured by the flow dispersion portion 2132*g*, it may be possible to reduce or prevent excessive pressure of or in the hot water tank assembly 2130. The flow dispersion portion 2132*g* may include an inclined surface facing the water inlet pipe 2132*a* in an inclined state. The inclined surface may disperse liquid and control a flow speed thereof through collision with liquid particles.

Particles in liquid introduced through the water inlet pipe 2132*a* may collide with flow dispersion portion 2132*g*, and thus a vortex may be formed in the flow dispersion portion 2132*g* and the liquid may be dispersed to various places within the hot water tank assembly 2130. Since the flow of liquid may have resistance as particles in liquid collide with the flow dispersion portion 2132*g*, the flow dispersion portion 2132*g* may control a flow speed of the liquid. The flow dispersion portion 2132*g* may form a flow resistance. Since the flow speed of the liquid is reduced by the flow resistance, it may be possible to provide a time period to sufficiently heat the liquid.

The flow joining portion 2132*h* may be connected to the water outlet pipe 2132*b* of the hot water tank assembly 2130 so as to provide hot water within a uniform temperature range by mixing liquid to be discharged through the water outlet pipe 2132*b*. When liquid discharged from the hot water tank assembly 2130 is discharged in a non-appropriately mixed state, excessively hot water may be discharged or non-sufficiently heated hot water may be discharged. Accordingly, in order to discharge hot water in the uniform temperature range, mixing with liquid by the flow joining portion 2132*h* may be required.

The flow joining portion 2132*h* may protrude in a direction away from the first cover 2131 such that a distance may be increased between the flow joining portion 2132*h* and the first cover 2131. Referring to FIG. 4B, the distance between the flow joining portion 2132*h* and the first cover 2131 may be larger than that of the base surface 2132*c* and the first cover 2131. Since a wide passage may be secured by the flow joining portion 2132*h*, it may be possible to suppress excessive pressure of or in the hot water tank assembly 2130. The flow joining portion 2132*h* may include an inclined surface that faces the water inlet pipe 2132*a* in an inclined state. Control of the flow speed and joining or mixture of liquid may be carried out by the inclined surface. Liquid to be discharged through the water outlet pipe 2132*b* may be collected along the flow joining portion 2132*h*, and a vortex may be formed in the flow joining portion 2132*h*. Liquids may be mixed with each other by collision between particles by the vortex.

The flow dispersion portion 2132*g* and the flow joining portion 2132*h* may be integrally formed with the base surface 2132*c* by press processing. When press processing is carried out on both sides of the second cover 2132 having the base surface 2132*c*, the flow joining portion 2132*h* and the flow dispersion portion 2132*g* may be formed, respectively. A coupling hole 2132*i* may be formed on the second cover 2132. The coupling hole may help to assemble the hot water tank assembly 2130 to an outer case 2143.

The working coil assembly 2140 may be provided at one side of the hot water tank assembly 2130. Referring to FIG. 4A and FIG. 4B, the working coil assembly 2140 may be provided at a position that faces an outer surface of the first cover 2131. For the sake of convenience of explanation, between two surfaces of the first cover 2131, a surface that faces the second cover 2132 may be referred to as an inner surface, and a surface that faces the working coil assembly 2140 may be referred to as an outer surface. Accordingly, one side of the hot water tank assembly 2130 may correspond to a position that faces an outer surface of the first cover 2131.

The working coil assembly 2140 may include the outer case 2143, a working coil 2144, a gap spacer 2145, a core 2146, a temperature sensor 2147, and an overheating protection fuse 2148. Heat generated from the first cover 2131 may be transmitted to the working coil assembly 2140, and each constituent element of the working coil assembly 2140 may be formed of a material having a thermal resistance.

The outer case 2143 may be coupled to other constituent elements of the working coil assembly 2140 to support the other constituent elements. The other constituent elements may be remaining constituent elements of the working coil assembly 2140 excluding the outer case 2143. The working coil 2144 and the gap spacer 2145 may have a ring shape in which a center thereof may be hollow. The outer case 2143 may include a portion capable of being inserted into the center of the working coil 2144 and the gap spacer 2145.

The outer case 2143 may include a position fixing portion 2143*g* that corresponds to an inner circumference of the working coil 2144 and the gap spacer 2145. The position fixing portion 2143*g* may protrude from the outer case 2143 to support the inner circumference of the working coil 2144. However, a structure of the outer case 2143 that couples the outer case 2143 to the working coil 2144 and the gap spacer

2145, and a structure to support the working coil 2144 and gap spacer 2145 may not be particularly limited thereto.

The outer case 2143 may be coupled to the hot water tank assembly 2130 to support the hot water tank assembly 2130. The coupling hole 2132*i* that corresponds to the outer case 2143 may be formed on the second cover 2132. When a fastening member such as, for example, a screw, is inserted through the coupling hole 2132*i*, and the fastening member may be fastened to the boss portion 2143*a* of the outer case 2143, and a coupling between the hot water tank assembly 2130 and the outer case 2143 may be carried out. However, the structure of the outer case 2143 may not be particularly limited thereto.

The outer case 2143 may include an engaging portion or hook 2143*h* to prevent a release of the hot water tank assembly 2130. The engaging portion 2143*h* may protrude from or at an edge of the outer case 2143 to engage with an edge of the hot water tank assembly 2130. When an upper portion of the hot water tank assembly 2130 is strongly coupled to the outer case 2143 by a fastening member, a lower portion of the hot water tank assembly 2130 may move away from the outer case 2143.

Since the engaging portion 2143*h* engages with an edge of the hot water tank assembly 2130, the engaging portion 2143*h* may lock a lower portion of the hot water tank assembly 2130 such that the hot water tank assembly 2130 may not move away from the outer case 2143. Positions of the boss portion 2143*a* and the engaging portion 2143*h* may be interchangeable with each other.

Figure 3:
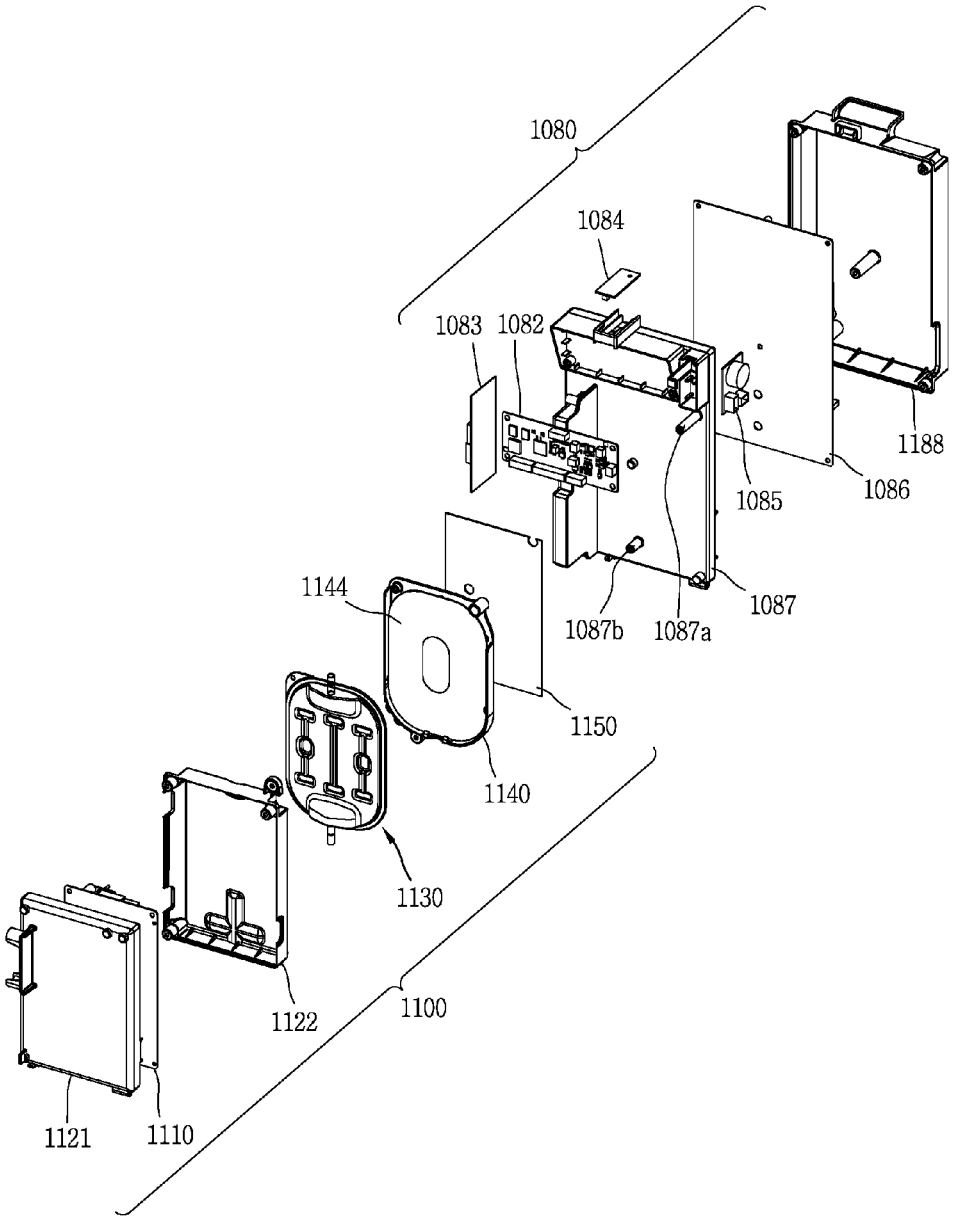
FIG. 3 is an exploded perspective view of an induction heater according to an embodiment.

The outer case 2143 may fix the hot water tank assembly 2130 to an inner portion of the water dispenser. Referring to FIG. 3 and FIG. 4A, boss portions 1087*a*, 1087*b*, 2143*b*1, 2143*b*2 may be provided on a corresponding front surface of the main printed circuit board cover 1087 and the outer case 2143, respectively.

When a fastening member is inserted into the boss portion 1087*a*, 1087*b* of the main printed circuit board cover 1087 through the boss portion 2143*b*1, 2143*b*2 of the outer case 2143, the outer case 2143 may be fixed to an inner portion of the water dispenser. The outer case 2143 may be coupled to the hot water tank assembly 2130, and thus the outer case 2143 may fix the hot water tank assembly 2130 to an inner portion of the water dispenser.

A plurality of hot water tank support portions 2143*c* may protrude from the outer case 2143 to support the hot water tank assembly 2130. The hot water tank support portions 2143*c* may be separated from each other along a line that corresponds to an edge of the hot water tank assembly 2130.

Referring to FIG. 4B, the outer case 2143 may include a plurality of core accommodation portions 2143*d* provided in a radial shape. The core accommodation portion 2143*d* may be a size that corresponds to the core 2146 to accommodate the core 2146. A plurality of cores 2146 may be inserted into each core accommodation portion 2143*d*.

The working coil 2144 may be formed by a conducting wire wound in an annular shape. The working coil 2144 may be formed with a single or several strands, and may be formed of copper or other conducting wires. Each strand may be insulated. The working coil 2144 may form a magnetic field or magnetic field lines by a current applied to the working coil 2144. The first cover 2131 may receive effects of magnetic field lines formed by the working coil 2144 to implement induction heating. In FIG. 4A and FIG. 4B, strands of the working coil 2144 are not illustrated in detail, and only an overall outline of the working coil 2144 is shown to be wound and formed.

The working coil 2144 may be provided at one side of the hot water tank assembly 2130. The working coil 2144 and the hot water tank assembly 2130 may face each other while at separate positions. Referring to FIG. 4A and FIG. 4B, the working coil 2144 may be provided at a position facing an outer surface of the first cover 2131. For the sake of convenience of explanation, between two surfaces of the first cover 2131, a surface facing the second cover 2132 may be referred to as an inner surface, and a surface facing the working coil assembly 2140 may be referred to as an outer surface. Accordingly, one side of the hot water tank assembly 2130 may correspond to a position facing the outer surface of the first cover 2131.

Since the hot water tank assembly 2130 may be induction heated by the working coil 2144, maintenance of a predetermined distance between the working coil 2144 and the hot water tank assembly 2130 may be very important. The gap spacer 2145 may be provided between the working coil 2144 and the hot water tank assembly 2130 to maintain a predetermined distance between the working coil 2144 and the hot water tank assembly 2130.

The gap spacer 2145 may be provided between the first cover 2131 and the working coil 2144. The gap spacer 2145 may maintain a distance between the first cover 2131 and the working coil 2144. In order for the first cover 2131 to sufficiently generate heat by receiving the effect of magnetic field lines formed by the working coil 2144, the distance between the first cover 2131 and the working coil 2144 may play an important role. When the distance between the first cover 2131 and the working coil 2144 is too close or too far, the first cover 2131 may not be in a range of the magnetic field. The gap spacer 2145 may be formed of a flame-retardant material, for example, the gap spacer 2145 may be formed of silica. The gap spacer 2145 may have a thickness of about 2 mm.

When the outer case 2143 is coupled to the hot water tank assembly 2130 by a fastening member, both surfaces of the gap spacer 2145 may be pressurized by the hot water tank assembly 2130 and the working coil 2144. Nevertheless, the outer case 2143 and the hot water tank assembly 2130 may be coupled to each other by the fastening member because the outer case 2143 constantly may maintain the distance between the hot water tank assembly 2130 and the working coil 2144.

If a distance between the hot water tank assembly 2130 and the working coil 2144 is smaller during coupling of the outer case 2143 to the hot water tank assembly 2130 by a fastening member, then induction heating may not be accurately controlled. However, the gap spacer 2145 may constantly maintain a gap between the hot water tank assembly 2130 and the working coil 2144, and thus the outer case 2143 and the hot water tank assembly 2130 may be coupled to each other, thereby not causing a problem in the control of induction heating. A plurality of gap spacers 2145 may be provided to set a distance between the hot water tank assembly 2130 and the working coil 2144. The gap spacer 2145 may be also provided between the working coil 2144 and the outer case 2143. The gap spacer 2145 may provide electrical insulation and thermal transfer suppression.

The core 2146 may be provided at an opposite side to the working coil 2144 based on the outer case 2143. The core 2146 may suppress loss of a current and may shield against magnetic field lines. Ferrite may be used for a material of the core 2146. The working coil assembly 2140 may include a plurality of cores 2146, and the plurality of cores 2146 may be provided in a radial shape based on a center of the outer case 2143 as shown in FIG. 4B.

The temperature sensor 2147 may measure the temperature of liquid heated in the hot water tank assembly 2130. The temperature sensor 2147 may be provided at an opposite side to the first cover 2131 by providing the gap spacer 2145 therebetween. A center of the working coil 2144 having an annular shape may be hollow, and thus the temperature sensor 2147 may be provided at the center of the working coil 2144. The temperature of hot water provided to a user in a water dispenser for supplying hot water may be maintained within an optimal range. When the temperature of hot water is not maintained within the optimal range due to a failure of the temperature sensor 2147, it may constitute a failure of the water dispenser.

The temperature sensor 2147 may measure the temperature of liquid heated in the hot water tank assembly 2130. The temperature measured by the temperature sensor 2147 may be provided to the induction heating printed circuit board 2110. The induction heating printed circuit board 2110 may determine whether or not to perform additional heating or suspend heating based on the temperature of the liquid measured on the temperature sensor 2147. Whether or not to perform additional heating or to suspend heating may be determined based on the temperature measured on the temperature sensor 2147. A thermistor may be used for the temperature sensor 2147.

The overheating protection fuse 2148 may be a safety device to block power of or from the induction heater 2100*a* when liquid within the hot water tank assembly 2130 may be excessively overheated. The temperature sensor 2147 may be classified as a return sensor, and the overheating protection fuse 2148 may be classified as a non-return sensor since it may need to be replaced once operated. A fuse accommodation portion 2143*e* formed to fix the overheating protection fuse 2148 may be provided in the outer case 2143. The fuse accommodation portion 2143*e* may be configured to surround the overheating protection fuse 2148. The working coil assembly 2140 may include a silicon cover 2149. The silicon cover 2149 may be provided at an inner hole of the working coil 2144. The silicon cover 2149 may configured to cover the temperature sensor 2147 and the overheating protection fuse 2148.

Figure 5:
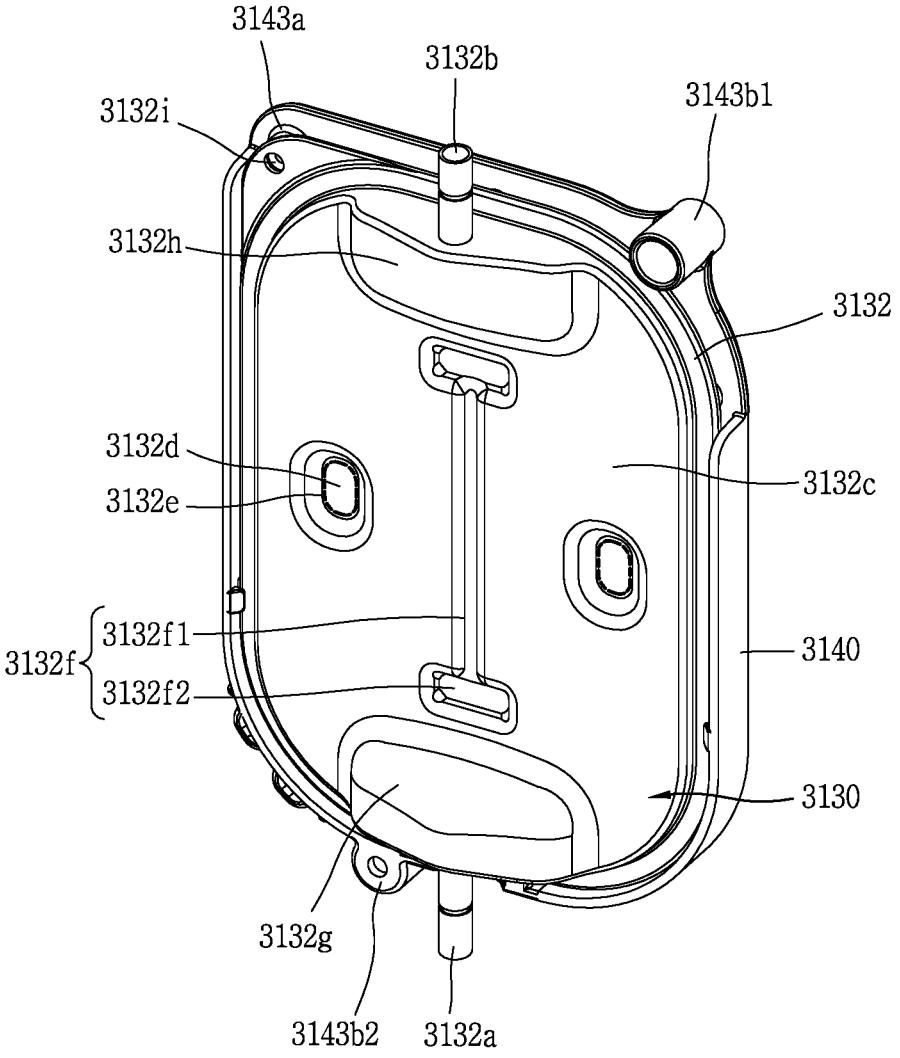
FIG. 5 is a perspective view of a hot water tank assembly according to another embodiment.

Referring to FIG. 5, a hot water tank assembly 3130 according to another embodiment may include a protrusion portion 3132*f*. The protrusion portion 3132*f* may include a first protrusion portion 3132*f*1 and a second protrusion portion 3132*f*2. The first protrusion portion 3132*f*1 may be extended toward a water inlet pipe 3132*a* and a water outlet pipe 3132*b* of the hot water tank assembly 3130. The first protrusion portion 3132*f*1 may prevent deformation of the second cover 3132 rather than distribution of a flow. The first protrusion portion 3132*f*1 may have a smaller width than that of the first protrusion portion 3132*f*1 in FIG. 4A and FIG. 4B.

The second protrusion portion 3132*f*2 may be extended in a direction that crosses an extension direction of the first protrusion portion 3132*f*1. Referring to FIG. 5, the first protrusion portion 3132*f*1 may be extended in a top-down direction, and the second protrusion portion 3132*f*2 may be extended in a left-right direction.

An extension length of the second protrusion portion 3132*f*2 may be larger than a width of the first protrusion portion 3132*f*1 because the second protrusion portion 3132*f*2 may be for the distribution of a flow and for the control of a flow speed rather than deformation prevention of the second cover 3132. In order to disperse liquid to be heated from the hot water tank assembly 3130, the second protrusion portion 3132*f*2 may collide with particles in liquid. The width of the second protrusion portion 3132*f*2 may be larger than that of the first protrusion portion 3132*f*1. The second protrusion portion 3132*f*2 may be relatively closer to the first cover 2131 compared to the first protrusion portion 3132*f*1 to provide a collision area, and a structure thereof may be shown in FIG. 11 and FIG. 12.

The second protrusion portions 3132*f*2 may be formed at both end portions of the first protrusion portion 3132*f*1, respectively. When both end portions of the first protrusion portion 3132*f*1 are referred to as a first end portion and a second end portion, respectively, in FIG. 5, the first end portion may be provided to be closer to the water inlet pipe 3132*a*, and the second portion may be provided to be closer to the water outlet pipe 3132*b*. The second protrusions may be formed at a first end portion and a second end portion of the first protrusion portion 3132*f*1.

The hot water tank assembly 3130 may include a plurality of second protrusion portions 3132*f*2. At least part of the plurality of second protrusion portions 3132*f*2 may be in contact with liquid introduced through the water inlet pipe 3132*a* or liquid to be discharged through the water outlet pipe 3132*b*. The contact with liquid may be collision with liquid particles. The flow distribution and flow speed control may be carried out through the structure of the second protrusion portion 3132*f*2.

A plurality of second protrusion portions 3132*f*2 may be shown in FIG. 5. Any one of the second protrusion portions 3132*f*2 may be provided at a position closer to the water inlet pipe 3132*a* to be brought into contact with liquid. Another second protrusion portion 3132*f*2 may be closer to the water outlet pipe 3132*b* to be brought into contact with liquid discharged through the water outlet pipe 3132*b*.

The second protrusion portion 3132*f*2 formed at a first end portion or an end portion at a side of the water inlet pipe 3132*a* of the first protrusion portion 3132*f*1 may be to distribute a flow, and the effect of dispersing a flow in all directions due to collision with liquid particles has been described above. The second protrusion portion 3132*f*2 formed at the first end portion may be for flow distribution.

The second protrusion portion 3132*f*2 formed at a first end portion of the first protrusion portion 3132*f*1 may be to control a flow speed, and the effect of sufficiently heating liquid within the hot water tank assembly 3130 according to the control of a flow speed has been described above. The second protrusion portion 3132*f*2 formed at the first end portion may be for flow speed control.

The second protrusion portion 3132*f*2 formed at a second end portion or an end portion at a side of the water outlet pipe 3132*b* of the first protrusion portion 3132*f*1 may be to control a flow speed. When liquids are mixed prior to being discharged from the hot water tank assembly 3130 according to the control of a flow speed, hot water in a uniform temperature range may be provided. The second protrusion portion 3132*f*2 formed at the second end portion may be for flow speed control.

The first protrusion portion 3132*f*1 and second protrusion portion 3132*f*2 may be integrally formed by press processing. When press processing is carried out on the second cover 3132 having the base surface 3132*c* based on an extension direction of the first protrusion portion 3132*f*1 and an extension direction of the second protrusion portion 3132*f*2, the first protrusion portion 3132*f*1 and the second protrusion portion 3132*f*2 are integrally formed along with the base surface 3132*c*.

Positions and number of the first protrusion portions 3132*f*1, second protrusion portions 3132*f*2 and welding portions 3132*e* may be selectively changed. An example may be described with reference to FIG. 5 through FIG. 9. Referring to FIG. 5, the first protrusion portion **3132*f*1 may be at a center of the second cover 3132, and the second protrusion portions 3132*f*2 may be provided at both end portions of the first protrusion portion 3132*f*1, respectively. The welding portions 3132*e* may be provided at both end portions of the first protrusion portion 3132*f*1, respectively. The welding portion 3132*e* may be separated from the first protrusion portion 3132*f*1, and both sides of the first protrusion portion 3132*f*1 may be at a left and right of the first protrusion portion 3132*f*1 based on FIG. 5**.

In FIG. 5, reference numerals **3132*d*, 3132*g*, 3132*h* and 3140** may be a protruding surface, a flow dispersion portion, a flow joining portion, and a working coil assembly, respectively. Description thereof is redundant to a description provided above, and has been omitted due to the previous description.

Figure 6:
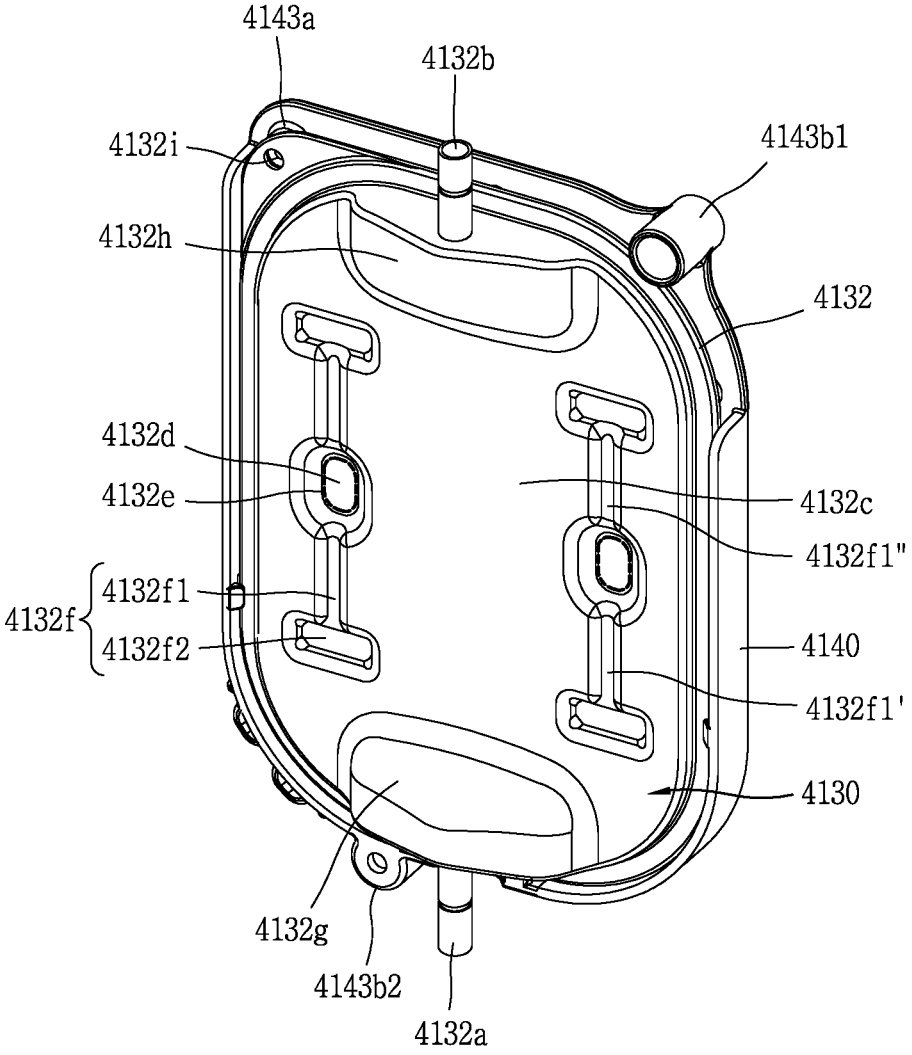
FIG. 6 is a perspective view of a hot water tank assembly according to another embodiment.

Referring to FIG. 6, a hot water tank assembly 4130 according to another embodiment may include a second cover 4132. The second cover 4132 may include a plurality of first protrusion portions **4132*f*1, second protrusion portions 4132*f*2, and welding portions 4132*e*. The first protrusion portion 4132*f*1 may be formed to overlap with the welding portion 4132*e*. Overlapping may be when the first protrusion portions 4132*f*1 pass through the welding portion 4132*e* as shown in FIG. 6**.

The first protrusion portion **4132*f*1 may include a first portion 4132*f*1' and a second portion 4132*f*1" extended in opposite directions to each other around the welding portion 4132*e*. For example, when a water inlet pipe 4132*a* and a water outlet pipe 4132*b* are provided at opposite directions to each other, the first portion 4132*f*1' may be extended toward the water inlet pipe 4132*a*, and the second portion 4132*f*1" may be extended toward the water outlet pipe 4132*b***.

The first protrusion portion **4132*f*1, the second protrusion portion 4132*f*2 and the welding portion 4132*e* may be provided at both sides around the second cover 4132. Referring to FIG. 6, the first protrusion portion 4132*f*1, the second protrusion portion 4132*f*2 and the welding portion 4132*e* may be provided on a left and right of a center of the second cover 4132**.

In FIG. 6, reference numerals **4132*a*, 4132*b*, 4132*c*, 4132*d*, 4132*f*, 4132*g*, 4132*h* and 4140** may be a water inlet pipe, a water outlet pipe, a base surface, a protruding surface, a protrusion portion, a flow dispersion portion, a flow joining portion, and a working coil assembly, respectively. Description thereof is redundant to a description provided above, and has been omitted due to the previous description.

Figure 7:
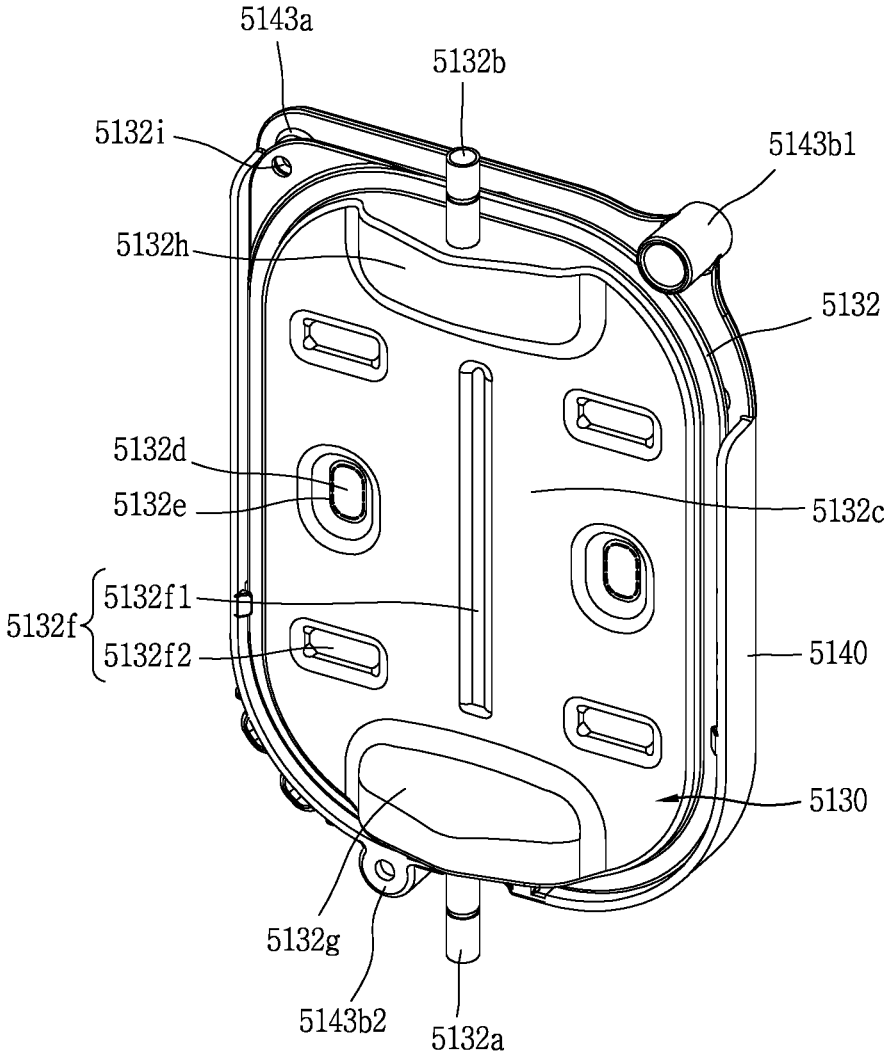
FIG. 7 is a perspective view of a hot water tank assembly according to another embodiment.

Referring to FIG. 7, a hot water tank assembly 5130 according to another embodiment may include a first protrusion portion **5132*f*1 and a second protrusion portion 5132*f*2, which may be separated from each other. The first protrusion portion 2132*f*1, 3132*f*1, 4132*f*1 and the second protrusion portion 2132*f*2, 3132*f*2, 4132*f*2 shown in FIG. 4A, FIG. 4B, FIG. 5 and FIG. 6 may be all adjacent to each other. However, the first protrusion portion 5132*f*1 and second protrusion portion 5132*f*2 may not be necessarily adjacent to each other. For example, as shown in FIG. 7, the first protrusion portion 5132*f*1 may be provided at a center of a second cover 5132, and welding portions 5132*e* may be provided on a left and right of the first protrusion portion 5132*f*1, and the second protrusion portion 5132*f*2 may be formed at a top and bottom of each welding portion 5132*e***, respectively.

In FIG. 7, reference numerals **5132*a*, 5132*b*, 5132*c*, 5132*d*, 5132*f*, 5132*g*, 5132*h* and 5140** may be a water inlet pipe, a water outlet pipe, a base surface, a protruding surface, a protrusion portion, a flow dispersion portion, a flow joining portion, and a working coil assembly, respectively. Description thereof is redundant to a description provided above, and has been omitted due to the previous description.

Figure 8:
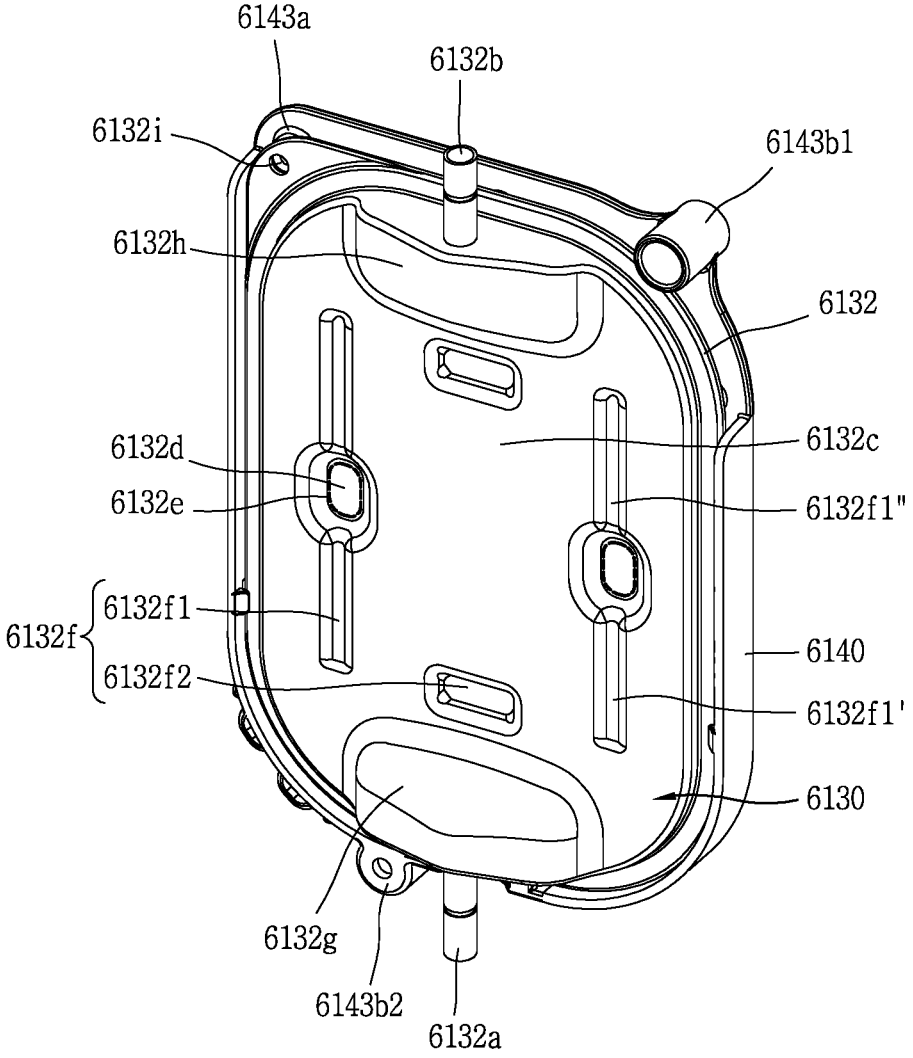
FIG. 8 is a perspective view of a hot water tank assembly according to another embodiment.

Referring to FIG. 8, a hot water tank assembly 6130 according to another embodiment may be provided. Comparing FIG. 7 with FIG. 8, positions of first protrusion portion **6132*f*1 and second protrusion portion 6132*f*2 may be exchanged with each other. A first protrusion portion 6132*f*1 may be formed at a position overlapping with a welding portion 6132*e*, and a second protrusion portions 6132*f*2 may be formed at a top and bottom around a center of a second cover 6132. The second protrusion portions 6132*f*2 may be formed between the first protrusion portion 6132*f*1 on the left and the second protrusion portion 6132*f*2** on the right.

In FIG. 8, reference numerals **6132*a*, 6132*b*, 6132*c*, 6132*d*, 6132*f*, 6132*f*1', 6132*f*1", 6132*g*, 6132*h* and 6140** may be a water inlet pipe, a water outlet pipe, a base surface, a protruding surface, a protrusion portion, a first portion of a first protrusion portion, a second portion of a first protrusion portion, a flow dispersion portion, a flow joining portion, and a working coil assembly, respectively. Description thereof is redundant to a description provided above, and has been omitted due to the previous description.

Figure 9:
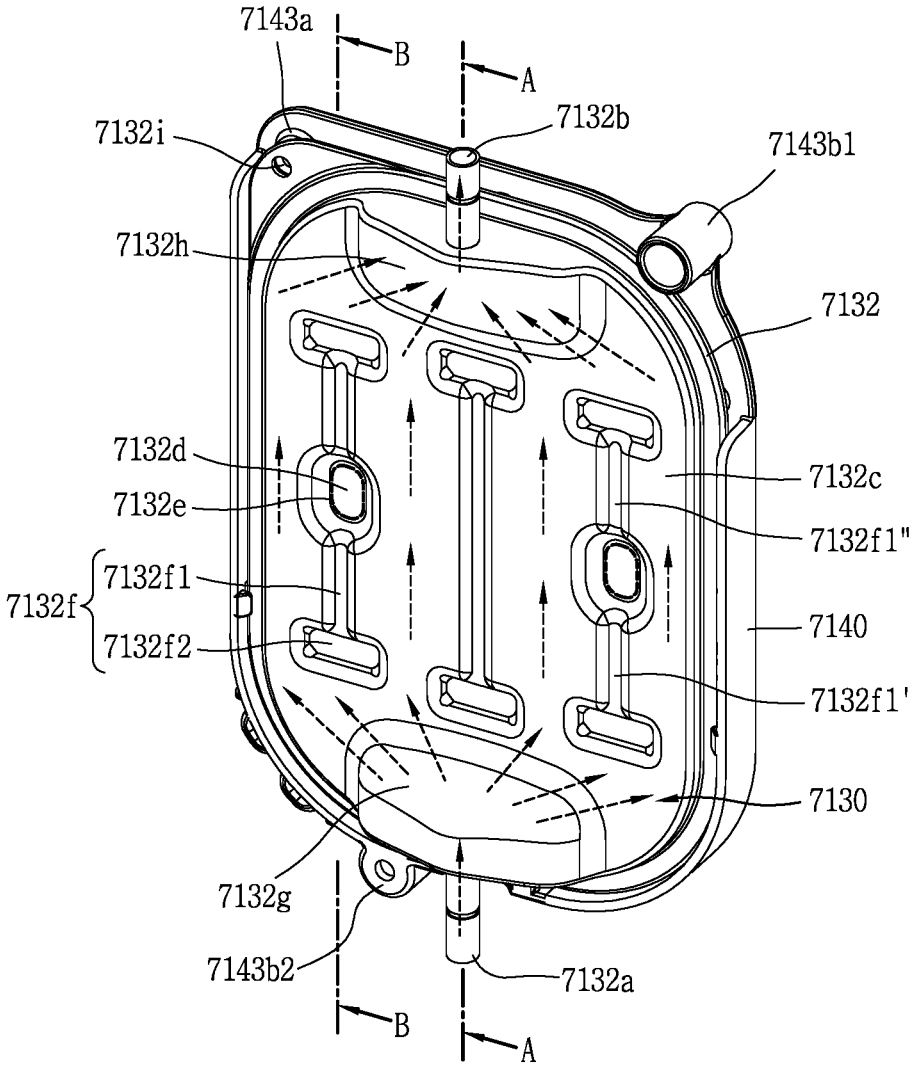
FIG. 9 is a perspective view of a hot water tank assembly according to another embodiment.

Referring to FIG. 9, a hot water tank assembly 7130 according to another embodiment may include a plurality of first protrusion portions **7132*f*1. A part of the plurality of first protrusion portions 7132*f*1 may be provided at a position overlapping with a welding portion 7132*e*, and another part thereof may be provided at a position that does not overlap with the welding portion 7132*e*. For example, referring to FIG. 9, welding portions 7132*e* may be provided on a left and right based on a center of a second cover 7132, and a part of the first protrusion portion 7132*f*1 may be extended in a top-down direction towards a water outlet pipe 7132*b* and towards the welding portion 7132*e*. The other part of the first protrusion portion 7132*f*1 may be provided between two welding portions 7132*e*. Second protrusion portions 7132*f*2 may be formed at both end portions of the first protrusion portion 7132*f*1**.

Arrows in FIG. 9 may refer to flow of liquid. Liquid introduced into the hot water tank assembly 7130 through a water inlet pipe **7132*a* may be dispersed by a flow dispersion portion 7132*g*. The flow dispersion portion 7132*g* may provide a flow resistance, and a flow speed of liquid may slow due to the flow resistance. The second protrusion portion 7132*f*2 at a side of the flow dispersion portion 7132*g* and the water inlet pipe 7132*a* may sequentially disperse liquid to control a flow speed of the liquid. Accordingly, the liquid may be sufficiently heated within the hot water tank assembly 7130**.

A flow speed of liquid flowing toward the water outlet pipe **7132*b* slows down again due to the second protrusion portion 7132*f*2 at a side of the water outlet pipe 7132*b*. Liquids at different temperatures may be mixed by collision of liquid particles in the flow speed joining portion 7132*h*. The liquid may become hot water within a uniform temperature range and may be discharged through the water outlet pipe 7132*b***.

A remaining configuration of the hot water tank assembly 7130 and a description of a working coil assembly 7140 may be substituted by the description of FIG. 4A and FIG. 4B. In FIG. 9 through FIG. 10B, reference numerals **6132*c*, 6132*d***,

6132*f*, 6132*f*1' and 6132*f*1" may be a base surface, a protruding surface, a protrusion portion, a first portion of a first protrusion portion, a second portion of a first protrusion portion, respectively. Description thereof is redundant to a description provided above, and has been omitted due to the previous description.

Figure 10A:
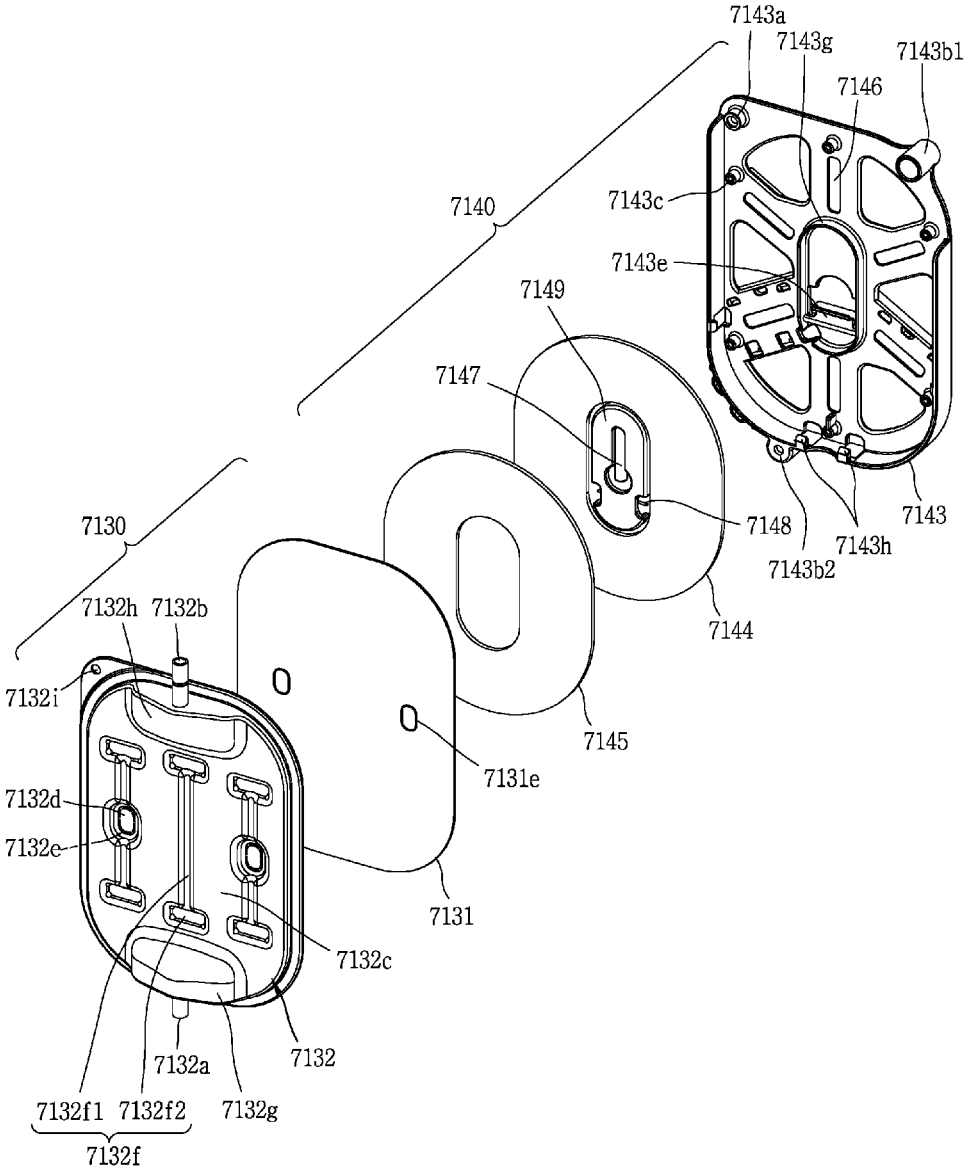
FIG. 10A and FIG. 10B are exploded perspective views of the hot water tank assembly from FIG. 9 viewed from different directions.
Figure 10B:
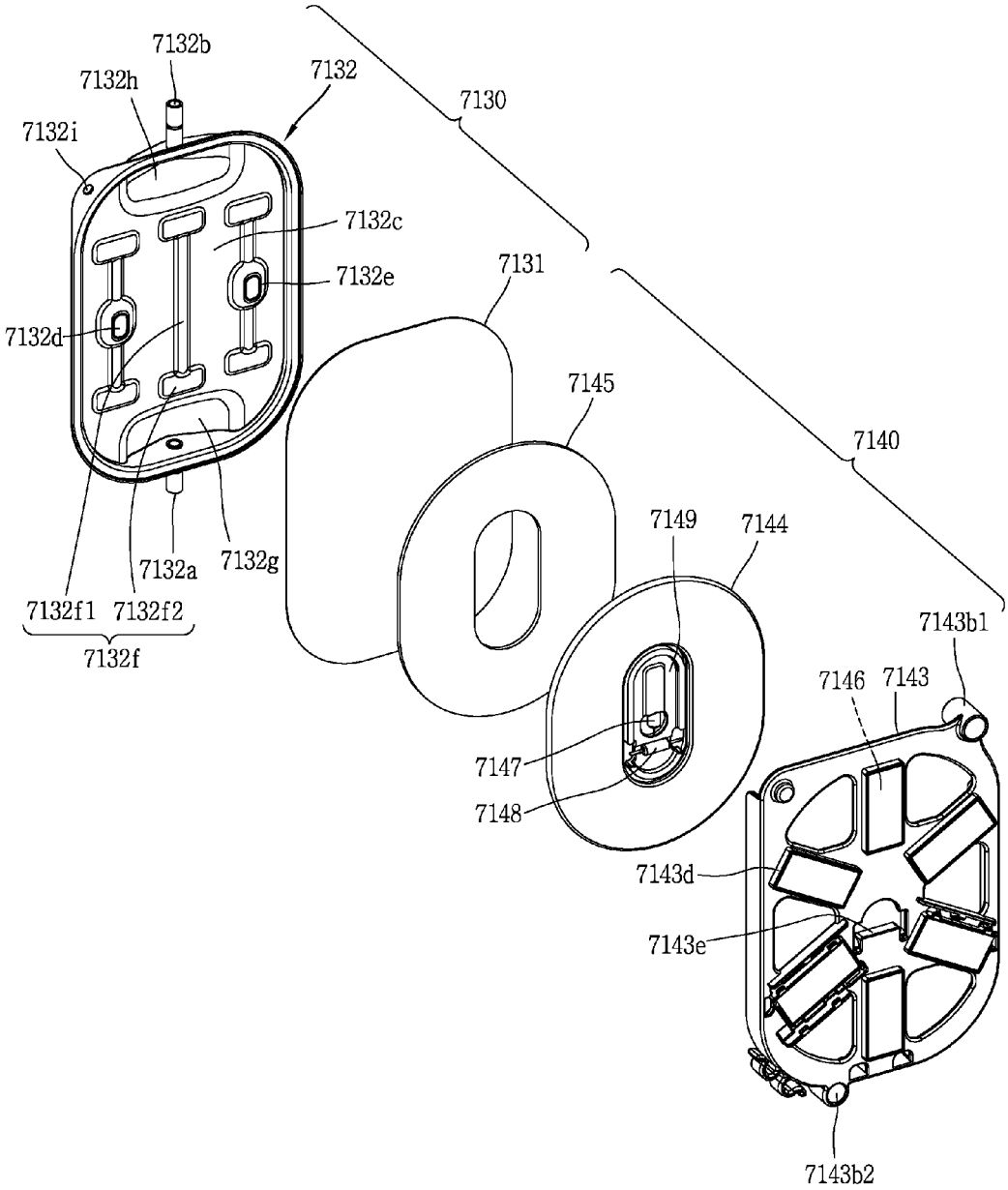

In FIG. 10A and FIG. 10B, reference numerals 7131, 7131*e*, 7143, 7144, 7145, 7146, 7147 and 7148 may be a first cover, a welding portion, an outer case, a working coil, a gap spacer, a core, a temperature sensor, and a fuse. The description thereof is redundant to the earlier description, and will be substituted by the earlier description.

Figure 11:
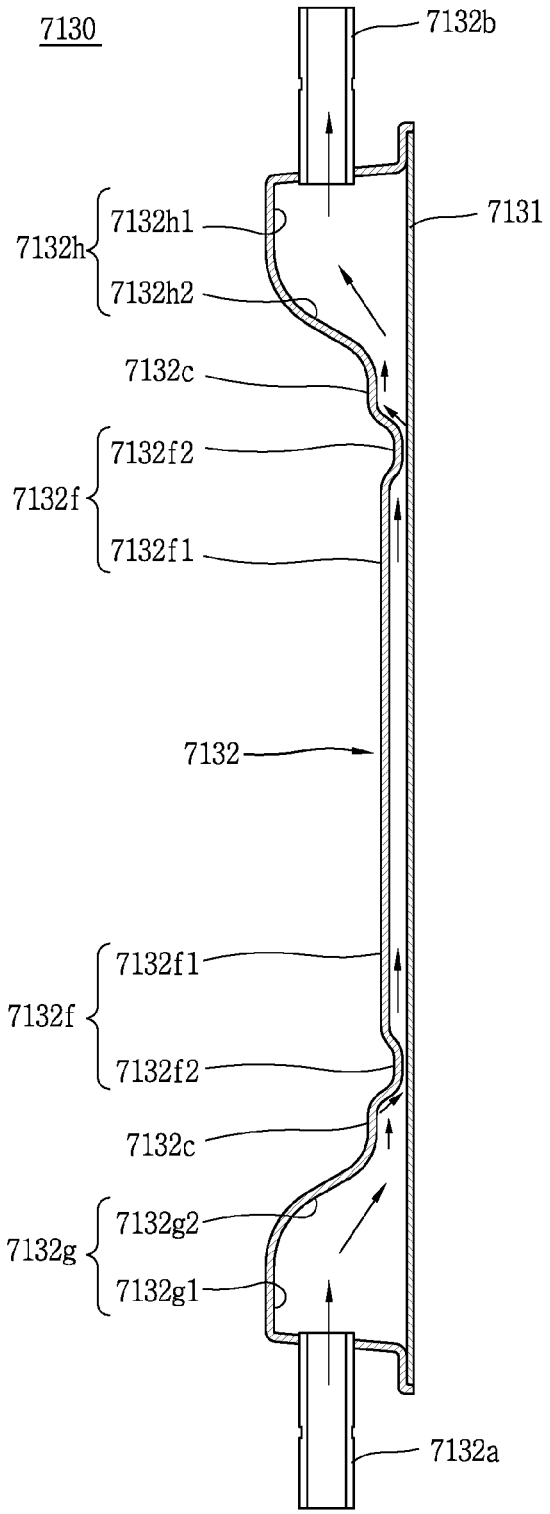
FIG. 11 is a cross-sectional view of the hot water tank assembly taken along line A-A in FIG. 9.

Referring to FIG. 11, the first protrusion portion 7132*f*1 may be protruded toward the first cover 7131 from the base surface 7132*c*. The first protrusion portion 7132*f*1 may be extended toward a water inlet pipe 7132*a* and a water outlet pipe 7132*b*.

The second protrusion portion 7132*f*2 may be protruded toward the first cover 7131 from the first protrusion portion 7132*f*1. The second protrusion portion 7132*f*2 may disperse a flow of liquid and control the flow speed of the liquid, and thus may be formed closer to the first cover 7131 than the first protrusion portion 7132*f*1.

The flow dispersion portion 7132*g* may include a separated surface 7132*g*1 and an inclined surface 7132*g*2. The separated surface 7132*g*1 may face the first cover 7131 at a position further separated from the first cover 7131 than the base surface 7132*c*. Since the separated surface 7132*g*1 is further separated from the first cover 7131 than the base surface 7132*c*, a larger passage than that of another portion may be formed on the flow dispersion portion 7132*g*.

The inclined surface 7132*g*2 may be formed at a circumference of the separated surface 7132*g*1. The inclined surface 7132*g*2 may be connected between the base surface 7132*c* and the separated surface 7132*g*1. The inclined surface 7132*g*2 may face the water inlet pipe 7132*a* at a position separated from the water inlet pipe 7132*a*. Since the inclined surface 7132*g*2 faces the water inlet pipe 7132*a* in an inclined state, particles in liquid introduced through the water inlet pipe 7132*a* may collide with the inclined surface 7132*g*2. Since particles collided with the inclined surface 7132*g*2 are dispersed in all directions, liquid introduced through the water inlet pipe 7132*a* may be dispersed to various places within the hot water tank assembly 7130 by the flow dispersion portion 7132*g*.

The inclined surface 7132*g*2 may provide a flow resistance to control the flow speed of the liquid. The flow speed of the liquid may be slowed by the inclined surface 7132*g*2. Accordingly, the flow dispersion portion 7132*g* may provide a sufficient heating time for the liquid.

The flow joining portion 7132*h* may include a separated surface 7132*h*1 and an inclined surface 7132*h*2. The separated surface 7132*h*1 may face the first cover 7131 at a position further separated from the first cover 7131 than the base surface 7132*c*. Since the separated surface 7132*h*1 is further separated from the first cover 7131 than the base surface 7132*c*, a larger passage than that of another portion may be formed on the flow joining portion 7132*h*.

The inclined surface 7132*h*2 may be formed at a circumference of the separated surface 7132*h*1. The inclined surface 7132*h*2 may be connected between the base surface 7132*c* and the separated surface 7132*g*1. The inclined surface 7132*h*2 may face the water outlet pipe 7132*b* at a position separated from the water outlet pipe 7132*b*. Since the inclined surface 7132*h*2 faces the water outlet pipe 7132*b* in an inclined state, particles in liquid to be discharged through the water outlet pipe 7132*b* may collide with each other to be mixed.

In FIG. 11, reference numerals 7132 and 7132*f* may be a second cover and a protrusion portion, respectively. Description thereof is redundant to a description provided above, and has been omitted due to the previous description.

Figure 12:
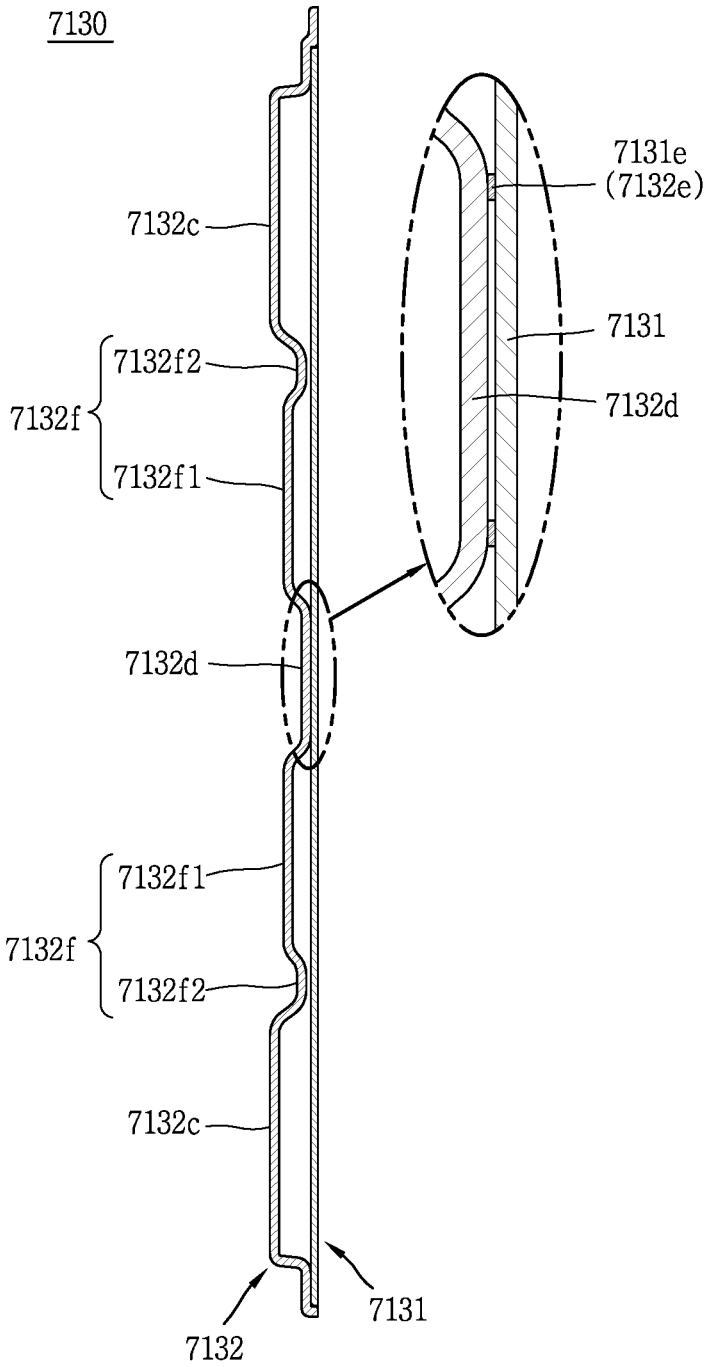
FIG. 12 is a cross-sectional view of the hot water tank assembly taken along line B-B in FIG. 9.

Referring to FIG. 12, a distance to the first cover 7131 may decrease to approach the first cover 7131 as being closer to the base surface 7132*c*, first protrusion portion 7132*f*1, second protrusion portion 7132*f*2 and protruding surface 7132*d*. In particular, the protruding surface 7132*d* may be closely adhered to the first cover 7131. The welding portion 7131*e*, 7132*e* may be formed by welding of the protruding surface 7132*d* and the first cover 7131. From a cross-section of FIG. 12, the welding portion 7131*e*, 7132*e* may have a closed curve shape.

In FIG. 12, reference numerals 7132 and 7132*f* may be a second cover and a protrusion portion, respectively. Description thereof is redundant to a description provided above, and has been omitted due to the previous description.

Figure 13:
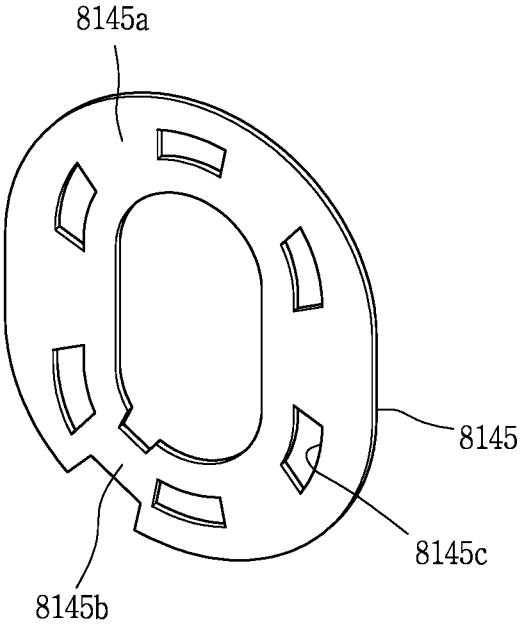
FIG. 13 is a perspective view of a gap spacer of a hot water tank assembly according to an embodiment.

Referring to FIG. 13, a gap spacer 8145 applicable to embodiments previously described may satisfy six conditions. The first condition may be that even when the gap spacer 8145 is pressurized in and by the hot water tank assembly 1130, 2130, 3130, 4130, 5130, 6130, 7130 (refer to FIGS. 3 through 12) and working coil 1144, 2144, 7144 (refer to FIGS. 3, 4A, 4B, 10A through 10B), the gap spacer 8145 may be able to maintain a constant distance between the working coil 1144, 2144, 7144 and the hot water tank assembly 1130, 2130, 3130, 4130, 5130, 6130, 7130. In order to accurately control induction heating, it has been described above that a distance between the hot water tank assembly 1130, 2130, 3130, 4130, 5130, 6130, 7130 and the working coil 1144, 2144, 7144 may need to be constantly maintained. When the gap spacer 8145 is provided between the hot water tank assembly 1130, 2130, 3130, 4130, 5130, 6130, 7130 and the working coil 1144, 2144, 7144 and when one surface of the gap spacer 8145 is closely adhered to the hot water tank assembly 1130, 2130, 3130, 4130, 5130, 6130, 7130 and another surface of the gap spacer 8145 is closely adhered to the working coil 1144, 2144, 7144, a distance between the hot water tank assembly 1130, 2130, 3130, 4130, 5130, 6130, 7130 and working coil 1144, 2144, 7144 may be determined by a thickness of the gap spacer 8145.

If the gap spacer 8145 is pressurized by the hot water tank assembly 1130, 2130, 3130, 4130, 5130, 6130, 7130 and working coil 1144, 2144, 7144 and elastically deformed, then the thickness of the gap spacer 8145 may become smaller due to the pressurization, and a distance between the hot water tank assembly 1130, 2130, 3130, 4130, 5130, 6130, 7130 and the working coil 1144, 2144, 7144 may not be constantly maintained. Accordingly, the gap spacer 8145 may maintain or keep an original thickness without causing deformation even when pressurized by the hot water tank assembly 1130, 2130, 3130, 4130, 5130, 6130, 7130 and working coil 1144, 2144, 7144.

If the gap spacer 8145 has an appropriate strength, then it may maintain an original thickness without causing elastic deformation even when pressurized by the hot water tank assembly 1130, 2130, 3130, 4130, 5130, 6130, 7130 and working coil 1144, 2144, 7144. Accordingly, the first condition of the gap spacer 8145 may be that the gap spacer 8145 should have a strength that does not cause deformation even with pressurization by the hot water tank assembly 1130, 2130, 3130, 4130, 5130, 6130, 7130 and working coil 1144, 2144, 7144.

The second condition may be that the gap spacer 8145 may maintain an electrical insulation between the hot water tank assembly 1130, 2130, 3130, 4130, 5130, 6130, 7130 and the working coil 1144, 2144, 7144. A current may be applied to the working coil 1144, 2144, 7144 for induction heating. When a current applied to the working coil 1144, 2144, 7144 is conducted through the hot water tank assembly 1130, 2130, 3130, 4130, 5130, 6130, 7130, it may affect the induction heating of the hot water tank assembly 1130, 2130, 3130, 4130, 5130, 6130, 7130 because the induction heating is joule heating generated by an electrical resistance of the metal.

When an electrical insulation between the hot water tank assembly 1130, 2130, 3130, 4130, 5130, 6130, 7130 and the working coil 1144, 2144, 7144 is not maintained, it may be difficult to accurately control the induction heating of the hot water tank assembly 1130, 2130, 3130, 4130, 5130, 6130, 7130. Since the gap spacer 8145 is provided between the hot water tank assembly 1130, 2130, 3130, 4130, 5130, 6130, 7130 and the working coil 1144, 2144, 7144, the gap spacer 8145 may be formed of an electrical insulator.

The third condition may be that the gap spacer 8145 may suppress heat transfer between the hot water tank assembly 1130, 2130, 3130, 4130, 5130, 6130, 7130 and working coil 1144, 2144, 7144. When a current flows through the working coil 1144, 2144, 7144, the working coil 1144, 2144, 7144 generates heat, and the hot water tank assembly 1130, 2130, 3130, 4130, 5130, 6130, 7130 induction heated by the working coil 1144, 2144, 7144 may also generate heat, and thus there may be a danger of fire due to excessive heating by two heating elements.

The induction heater 1100 may be controlled based on a temperature measured by the temperature sensor 2147, 7147 (refer to FIGS. 4A, 4B, 10A and 10B). When the temperature sensor 2147, 7147 is affected by too many elements, an accurate control of the induction heater may be gradually deteriorated, and thus the number of elements causing an effect on the temperature sensor 2147, 7147 may be small to accurately control the induction heater 1100.

When heat transfer between the hot water tank assembly 1130, 2130, 3130, 4130, 5130, 6130, 7130 and the working coil 1144, 2144, 7144 is not suppressed, the number of elements causing an effect on a temperature measured by the temperature sensor 2147, 7147 may be large, and thus an accurate control of the induction heater 1100 may be gradually deteriorated. Since the gap spacer 8145 is provided between the hot water tank assembly 1130, 2130, 3130, 4130, 5130, 6130, 7130 and the working coil 1144, 2144, 7144, the gap spacer 8145 may suppress heat transfer between the hot water tank assembly 1130, 2130, 3130, 4130, 5130, 6130, 7130 and the working coil 1144, 2144, 7144.

The fourth condition may be that the gap spacer 8145 may be formed of a flame-retardant material having a thermal resistance. The gap spacer 8145 may be provided between the working coil 1144, 2144, 7144 and the hot water tank assembly 1130, 2130, 3130, 4130, 5130, 6130, 7130, and the temperature of the working coil 1144, 2144, 7144 and hot water tank assembly 1130, 2130, 3130, 4130, 5130, 6130, 7130 may be increased up to about 150° C., and thus if the gap spacer 8145 does not have a thermal resistance, then it may be damaged by heat.

Accordingly, the gap spacer 8145 may be formed of a flame-retardant material having a thermal resistance up to at least 200-300° C. not to be damaged even at a higher temperature than that of the heated working coil 1144, 2144, 7144 and the induction heated hot water tank assembly 1130, 2130, 3130, 4130, 5130, 6130, 7130. The gap spacer 8145 may be formed of any one of mica, quartz and glass to satisfy the first through the fourth conditions. Mica, quartz, or glass may maintain its thickness even when pressurized by the hot water tank assembly 1130, 2130, 3130, 4130, 5130, 6130, 7130 and working coil 1144, 2144, 7144, and are flame-retardant materials having electrical insulation, suppressed heat transfer, and sufficient thermal resistance properties.

The gap spacer 8145 may be formed of silicon (Si) to satisfy the second through the fourth conditions. Silicon is a flame-retardant material having electrical insulation, suppressed heat transfer, and sufficient thermal resistance properties. However, silicon may cause an elastic deformation when excessively pressurized by the hot water tank assembly 1130, 2130, 3130, 4130, 5130, 6130, 7130 and working coil 1144, 2144, 7144. Accordingly, silicon may be used as a material of the gap spacer 8145 only when it is not excessively pressurized by the hot water tank assembly 1130, 2130, 3130, 4130, 5130, 6130, 7130 and working coil 1144, 2144, 7144.

The fifth condition of the gap spacer 8145 may be that the gap spacer 8145 may have a structure capable of allowing the gap spacer 8145 to pass through both ends of the working coil 1144, 2144, 7144. The working coil 1144, 2144, 7144 may be formed by a conducting wire in an annular shape, and an end thereof may be extended from an inner side of the annular shape and connected to the induction heating printed circuit board 1110, and another end of the working coil 1144, 2144, 7144 may be extended from an outer side of the annular shape and connected to the induction heating printed circuit board 1110.

The gap spacer 8145 may be formed in an annular shape to correspond to the working coil 1144, 2144, 7144, and may include a first portion 8145*a* and a second portion 8145*b* to allow both ends of the working coil 1144, 2144, 7144 to pass therethrough. The first portion 8145*a* may be a part of the annular shape. The second portion 8145*b* may be a remaining part of the annular shape, and may have a smaller width than that of the first portion 8145*a*. In particular, the second portion 8145*b* may be recessed at an inner side and an outer side of the annular shape, respectively, to have a smaller width than that of the first portion 8145*a*. Accordingly, a gap capable of allowing both ends of the working coil 1144, 2144, 7144 to pass therethrough may be formed at an inner side and an outer side of the annular shape. An end of the working coil 1144, 2144, 7144 may pass through an inner side of the annular shape, and the other end of the working coil 1144, 2144, 7144 may pass through an outer side of the annular shape.

The sixth condition of the gap spacer 8145 may be that the gap spacer 8145 may be formed with a structure capable of implementing the cooling of the working coil 1144, 2144, 7144. Since heat generated from the hot water tank assembly 1130, 2130, 3130, 4130, 5130, 6130, 7130 by induction heating is transferred to liquid passing through the hot water tank assembly 1130, 2130, 3130, 4130, 5130, 6130, 7130, cooling due to liquid may be carried out on the hot water tank assembly 1130, 2130, 3130, 4130, 5130, 6130, 7130. Since the working coil 1144, 2144, 7144 is closely adhered to the gap spacer 8145 and the gap spacer 8145 may be configured to suppress heat transfer, the working coil 1144, 2144, 7144 may have no target to transfer heat excluding air.

Accordingly, an area capable of allowing the working coil 1144, 2144, 7144 to be sufficiently brought into contact with air may be provided to carry out the cooling of the working coil 1144, 2144, 7144. The gap spacer 8145 may include a hole 8145*c* that allows the hot water tank assembly 1130, 2130, 3130, 4130, 5130, 6130, 7130 and working coil 1144, 2144, 7144 to face each other. The hole 8145*c* may be formed on the first portion 8145*a*, and a plurality of holes 8145*c* may be provided and formed to be separated from each other along the gap spacer 8145 in an annular shape.

The working coil 1144, 2144, 7144 and the hot water tank assembly 1130, 2130, 3130, 4130, 5130, 6130, 7130 may be provided to face each other at separate positions, and the working coil 1144, 2144, 7144 and the hot water tank assembly 1130, 2130, 3130, 4130, 5130, 6130, 7130 may face each other through the hole 8145*c*. The working coil 1144, 2144, 7144 may be separated from the hot water tank assembly 1130, 2130, 3130, 4130, 5130, 6130, 7130, and thus the working coil 1144, 2144, 7144 may be brought into contact with air through the hole 8145*c*. Accordingly, the hole 8145*c* may form a contact area between the working coil 1144, 2144, 7144 and air.

Referring to FIG. 2 again, the water dispenser 1000 may include a fan 1033, and wind generated by the fan 1033 may promote air flow within the water dispenser 1000. Accordingly, when wind generated by the fan 1033 is transferred to the working coil 1144, 2144, 7144 through the hole 8145*c*, it may further promote the cooling of the working coil 1144, 2144, 7144 compared to just natural convection of air.

There may be provided a plurality of gap spacers 8145. For example, when a distance between the hot water tank assembly 1130, 2130, 3130, 4130, 5130, 6130, 7130 and the working coil 1144, 2144, 7144 may need to be constantly maintained at 3.5 mm, three gap spacers 8145 with a thickness of 1 mm and one gap spacer 8145 with a thickness of 0.5 mm may be provided between the hot water tank assembly 1130, 2130, 3130, 4130, 5130, 6130, 7130 and the working coil 1144, 2144, 7144. A plurality of gap spacers 8145 may be provided to be closely adhered to each other to determine a distance between the hot water tank assembly 1130, 2130, 3130, 4130, 5130, 6130, 7130 and working coil 1144, 2144, 7144 by a thickness of the gap spacer 8145.

According to embodiments disclosed herein, a welding portion formed by welding of a first cover and a second cover may prevent deformation of the first cover. When an internal pressure of the hot water tank assembly is increased during operation an induction heater, the first cover may be swollen in a direction away from the second cover to cause the deformation and malfunction of the hot water tank assembly, but the welding portion may be maintained such that the first cover and the second cover are adhered to each other, thereby preventing deformation and malfunction.

Furthermore, a protrusion portion formed on the second cover may prevent deformation of the second cover as well as appropriately distribute a flow of liquid within the hot water tank assembly. The protrusion portion may be extended toward a water inlet pipe and a water outlet pipe to enhance rigidity of the second cover. Even when a pressure within the hot water tank assembly increases, it may be possible to prevent the deformation of the second cover due to the protrusion portion.

The protrusion portion may be formed to have an appropriate width in a direction that crosses an extension direction, and thus it may be possible to appropriately distribute a flow of liquid introduced into the hot water tank assembly through the water inlet pipe. When liquid particles collide with the protrusion portion, the liquid particles may disperse in all directions, and the flow of liquid may be naturally distributed to various places within the hot water tank assembly. As the protrusion portion distributes flow, liquid introduced into the hot water tank assembly may not be concentrated on one place, thereby allowing efficient heating.

The protrusion portion may include a first protrusion portion and a second protrusion portion. The first protrusion portion may be extended in a direction of the water inlet pipe and the water outlet pipe to enhance the rigidity of the second cover to prevent the deformation of the second cover. The second protrusion portion may be extended in a direction that crosses the first protrusion portion, and provided at a position colliding with particles in liquid to distribute flow.

Furthermore, a flow dispersion portion connected to the water inlet pipe may be configured to appropriately distribute a flow of liquid introduced through the water inlet pipe to various places in the hot water tank assembly. Accordingly, the liquid may be sufficiently heated within the hot water tank assembly. A flow joining portion connected to the water outlet pipe may be configured to join or mix a flow of liquid to be discharged through the water outlet pipe. Accordingly, liquids with inconsistent heating levels may be appropriately mixed by the flow joining portion.

A gap spacer provided between the hot water tank assembly and the working coil may be formed of mica, quartz or glass, and thus it may be possible to maintain a constant distance between the hot water tank assembly and the working coil. For example, as the hot water tank assembly and the outer case are coupled to each other by a screw, it may be possible to constantly maintain a thickness of the gap spacer even though the gap spacer may be pressurized. The gap spacer may be closely adhered to the hot water tank assembly and the working coil, and thus a distance between the hot water tank assembly and the working coil may be determined by the gap spacer. Accordingly, maintaining the gap spacer at a constant thickness also may maintain a distance between the hot water tank assembly and the working coil at a constant value.

Even when the hot water tank assembly and the outer case are coupled to each other by a screw, a distance between the hot water tank assembly and the working coil may be constantly maintained, and thus according to embodiments disclosed herein, positions of the working coil, hot water tank assembly and gap spacer may be fixed without any sealant. Moreover, compared to sealant, a screw fastening structure may not cause a different result during operation, and thus embodiments disclosed herein may be advantageous in mass production.

The induction heater and the water dispenser having the induction heater as described above are not limited to the configurations and methods of the foregoing embodiments, and all or part of each embodiment may be selectively combined and configured to make various modifications thereto.

Embodiments disclosed herein may provide a structure capable of preventing deformation in a hot water tank assembly provided with an induction heater and capable of appropriately distributing liquid flow or mixing the distributed liquid flow.

Embodiments disclosed herein may provide a structure capable of controlling a flow speed of liquid to be heated in a hot water tank assembly to sufficiently heat liquid within the hot water tank assembly and capable of providing hot water at a uniform temperature range.

Embodiments disclosed herein may provide an induction heater including a working coil and a gap spacer provided between the working coil and the hot water tank assembly to maintain a predetermined distance between the working coil and the hot water tank assembly.

Embodiments disclosed herein may provide an assembly structure capable of maintaining a predetermined distance between the working coil and the hot water tank assembly even when the working coil, the hot water tank assembly, and the gap spacer are assembled without any sealant and capable of accurately controlling an induction heating output for each induction heater even when the induction heaters are produced in a large quantity.

Embodiments disclosed herein may provide a water dispenser with a structure capable of suppressing heat generated from the working coil and the hot water tank assembly from being transferred to adjoining components and capable of cooling the working coil while maintaining a predetermined distance between the working coil and the hot water tank assembly.

According to embodiments disclosed herein, an induction heater may include a hot water tank assembly formed by coupling edges of a first cover and a second cover to each other and provided with an inner space to heat liquid. The first cover may be configured to have a flat plate shape and receive induction heat from a working coil, and the second cover may include a base configured to face the first cover at a position separated from the first cover, a welding portion formed by welding with the first cover and provided on a protruding surface protruded from the base surface toward the first cover, and a protrusion portion protruded from the base surface toward the first cover and extended toward a water inlet pipe and a water outlet pipe of the hot water tank assembly.

At least one welding portion may be formed at both sides of the protrusion portion, respectively. The protrusion portion may include a first portion and a second portion extended in opposite directions to each other around the welding portion. The welding portion may have a closed curve shape. The induction heater may include a temperature sensor provided at an opposite side to the second cover based on the first cover, and the welding portion may be formed at a position that may not overlap with the temperature sensor. The protrusion portion may include a first protrusion portion extended toward the water inlet pipe and the water outlet pipe; and a second protrusion portion extended in a direction that crosses an extension diction of the first protrusion portion.

The first protrusion portion and the second protrusion portion may be integrally formed by press processing. An extension length of the second protrusion portion may be larger than a width of the first protrusion portion. The second protrusion portions may be formed at both end portions of the first protrusion portion, respectively. The first protrusion portion may include a first portion and a second portion extended in opposite directions to each other around the welding portion, and the second protrusion portions may be formed at an end portion of the first portion and an end portion of the second portion, respectively. The hot water tank assembly may include a plurality of the second protrusion portions, and at least part of the plurality of the second protrusion portions may be provided to be brought into contact with liquid introduced into the water inlet pipe and liquid to be discharged through the water outlet pipe.

According to embodiments disclosed herein, an induction heater may include a flow dispersion portion and a flow joining portion. The induction heater may include a hot water tank assembly formed by coupling edges of a first cover and a second cover to each other and provided with an inner space to heat liquid, wherein the first cover may be configured to have a flat plate shape and to receive induction heat by or from a working coil, and the second cover may include a base configured to face the first cover at a position separated from the first cover; a flow dispersion portion connected to a water inlet pipe of the hot water tank assembly and formed in a protruding manner in a direction away from the first cover; and a flow joining portion connected to a water outlet pipe of the hot water tank assembly and formed in a protruding manner in a direction away from the first cover.

The flow dispersion portion and the flow joining portion may be integrally formed with the base surface by press processing. The flow dispersion portion and the flow joining portion may include a separated surface that faces the first cover at a position further separated from the first cover than the base surface; and an inclined surface formed at a circumference of the separated surface and connected between the base surface and the base separated surface. An inclined surface of the flow dispersion portion may be provided to face the water inlet pipe in an inclined state at a position separated from the water inlet pipe, and an inclined surface of the flow joining portion may be provided to face the water outlet pipe in an inclined state at a position separated from the water outlet pipe.

The induction heater may include an outer case coupled to the hot water tank assembly with the working coil provided therebetween and may be configured to support the hot water tank assembly. A gap spacer may be provided between the working coil and the hot water tank assembly to maintain a predetermined distance between the working coil and the hot water tank assembly, and may be formed to maintain a predetermined thickness even when pressed by a coupling between the hot water tank assembly and the outer case.

The gap spacer may be formed of any one of mica, glass, quartz and silicon (Si). One surface of the gap spacer may be closely adhered to the hot water tank assembly and another surface of the gap spacer may be closely adhered to the working coil assembly such that the distance between the hot water tank assembly and the working coil may be determined by a thickness of the gap spacer. The working coil may be formed with a conducting wire wound in an annular shape, and the gap spacer may be formed in an annular shape to correspond to the working coil. The gap spacer may include a first portion configured to form a part of the annular shape, and a second portion configured to form the remaining part of the annular shape, the second portion having a smaller width than a width of the first portion. The gap spacer may include a hole formed on or in the first portion.

An induction heater may include a hot water tank assembly formed by coupling edges of a first cover and a second cover, and provided with a water inlet pipe configured to receive liquid and a water outlet pipe configured to discharge liquid, and provided with an inner space to accommodate liquid; a working coil installed at a position facing an outer surface of the first cover; a gap spacer provided between the first cover and the working coil; and an outer case formed to support the working coil, wherein the first cover may be configured to have a flat plate shape, and the second cover may include a base configured to face the first cover at a position separated from the first cover; and a flow dispersion portion formed in a protruding manner in a direction away from the first cover.

The induction heater may include a temperature sensor installed to be supported by the outer case. The gap spacer may have an annular shape, a center of which may be hollow, and the temperature sensor may be provided at the hollow portion. The second cover may include a flow joining portion formed in a protruding manner in a direction away from the first cover.

The water outlet pipe may be installed at the flow joining portion. The water inlet pipe may be installed at the flow dispersion portion. The second cover may include a protrusion portion protruded from the base surface toward the first cover, and formed to be brought into contact with liquid introduced through the water inlet pipe.

A water purifier may be described as an example of the water dispenser, but an induction heater according to embodiments disclosed herein may not be necessarily limited to a water purifier or a water dispenser, and may be also applicable to all devices for heating liquid. In different embodiments according to the present disclosure, same or similar reference numerals may be designated to same or similar configurations, and description thereof may be substituted by an earlier description. Unless clearly used otherwise, expressions in the singular number used in the present disclosure may include a plural meaning.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An induction heater, comprising:

a working coil formed by a conducting wire wound in an annular shape;

a first cover;

a second cover;

a hot water tank assembly formed by coupling edges of the first cover and the second cover to each other, and provided with an inner space to heat liquid, the first cover formed of a metal material and having a flat plate corresponding to the working coil to be heated by the working coil;

a gap spacer formed in an annular shape corresponding to the working coil; and a temperature sensor provided in holes of the working coil and the gap spacer to face the hot water tank assembly.

2. The induction heater of claim 1, wherein the second cover includes:

a water inlet pipe configured to receive liquid; and a flow dispersion portion connected to the water inlet pipe and formed to protrude in a direction away from the first cover, wherein a distance between the flow dispersion portion and the first cover may be larger than that between the base and the first cover.

3. The induction heater of claim 1, wherein the second cover includes:

a water outlet pipe configured to discharge liquid; and a flow joining portion connected to the water outlet pipe and formed to protrude in a direction away from the first cover, wherein a distance between the flow joining portion and the first cover may be larger than that between the base and the first cover.

4. The induction heater of claim 3 wherein the flow joining portion includes:

a separated surface that faces the first cover at a position further separated from the first cover than the base; and an inclined surface formed at a circumference of the separated surface and connected between the base and the separated surface.

5. The induction heater of claim 4, wherein the inclined surface of the flow joining portion is provided to face the water outlet pipe in an inclined state and separated from the water outlet pipe.

6. The induction heater of claim 1, wherein the second cover includes:

a water inlet pipe configured to receive liquid;

a water outlet pipe configured to discharge liquid;

a flow dispersion portion connected to the water inlet pipe and formed to protrude in a direction away from the first cover, wherein a distance between the flow dispersion portion and the first cover may be larger than that between the base and the first cover; and a flow joining portion connected to the water outlet pipe and formed to protrude in a direction away from the first cover, wherein a distance between the flow joining portion and the first cover may be larger than that between the base and the first cover.

7. The induction heater any one of claims 2 and 6, wherein the flow dispersion portion includes:

a separated surface that faces the first cover at a position further separated from the first cover than the base; and an inclined surface formed at a circumference of the separated surface and connected between the base and the separated surface.

8. The induction heater of claims 7, wherein the inclined surface of the flow dispersion portion is provided to face the water inlet pipe in an inclined state and separated from the water inlet pipe.

9. The induction heater of claim 1, wherein the second cover includes a protrusion portion protruding from the base toward the first cover.

10. An induction heater, comprising:

a working coil formed by a conducting wire wound in an annular shape;

a first cover;

a second cover; and a hot water tank assembly formed by coupling edges of the first cover and the second cover to each other, and provided with an inner space to heat liquid, the first cover formed of a metal material having a flat plate corresponding to the working coil to be heated by the working coil, wherein the second cover includes:

a base configured to face the first cover, separated from the first cover and forming the inner space with the first cover;

a water inlet pipe configured to receive liquid; and a flow dispersion portion connected to the water inlet pipe and formed to protrude in a direction away from the first cover, wherein a distance between the flow dispersion portion and the first cover is larger than that between the base and the first cover, wherein the flow dispersion portion includes:

a water inlet pipe connection surface protruding in the direction away from the first cover, and connected to the water inlet pipe;

a separated surface that faces the first cover at a position further separated from the first cover than the base; and an inclined surface formed at a circumference of the separated surface, connected between the base and the separated surface, provided to face the water inlet pipe in an inclined state, and separated from the water inlet pipe.

11. The induction heater of claim 10, wherein the second cover includes a protrusion portion protruding from the base toward the first cover.

12. The induction heater of claim 11, wherein the second cover includes a welding portion formed by welding with the first cover and formed on a protruding surface that protrudes from the base toward the first cover.

13. An induction heater, comprising:

a working coil formed by a conducting wire wound in an annular shape;

a first cover;

a second cover; and a hot water tank assembly formed by coupling edges of the first cover and the second cover to each other, and provided with an inner space to heat liquid, the first cover formed of a metal material and having a flat plate corresponding to the working coil to be heated by the working coil, wherein the second cover includes:

a base configured to face the first cover, separated from the first cover, and forming the inner space with the first cover;

a water outlet pipe configured to discharge liquid; and a flow joining portion connected to the water outlet pipe and formed to protrude in a direction away from the first cover, wherein a distance between the flow joining portion and the first cover is larger than that between the base and the first cover, and wherein the flow joining portion includes:

a water outlet pipe connection surface protruding in the direction away from the first cover, and connected to the water outlet pipe;

a separated surface that faces the first cover at a position further separated from the first cover than the base; and an inclined surface formed at a circumference of the separated surface, connected between the base and the separated surface, provided to face the water outlet pipe in an inclined state, and separated from the water outlet pipe.

14. The induction heater of claim 13, wherein the second cover includes a protrusion portion protruding from the base toward the first cover.

15. The induction heater of claim 14, wherein the second cover includes a welding portion formed by welding with the first cover and formed on a protruding surface that protrudes from the base toward the first cover.

16. An induction heater, comprising:

a working coil formed by a conducting wire wound in an annular shape;

a first cover;

a second cover; and a hot water tank assembly formed by coupling edges of the first cover and the second cover to each other, and provided with an inner space to heat liquid, the first cover formed of a metal material and having a flat plate corresponding to the working coil to be heated by the working coil, wherein the second cover includes:

a base configured to face the first cover, separated from the first cover, and forming the inner space with the first cover;

a water inlet pipe configured to receive liquid;

a water outlet pipe configured to discharge liquid;

a flow dispersion portion connected to the water inlet pipe and formed to protrude in a direction away from the first cover, wherein a distance between the flow dispersion portion and the first cover is larger than that between the base and the first cover; and a flow joining portion connected to the water outlet pipe and formed to protrude in a direction away from the first cover, wherein a distance between the flow joining portion and the first cover is larger than that between the base and the first cover, wherein the flow dispersion portion includes:

a water inlet pipe connection surface protruding in the direction away from the first cover, and connected to the water inlet pipe;

a first separated surface that faces the first cover at a position further separated from the first cover than the base; and a first inclined surface formed at a circumference of the first separated surface, connected between the base and the first separated surface, provided to face the water inlet pipe in an inclined state, and separated from the water inlet pipe, wherein the flow joining portion includes:

a water outlet pipe connection surface protruding in the direction away from the first cover, and connected to the water outlet pipe;

a second separated surface that faces the first cover at a position further separated from the first cover than the base; and a second inclined surface formed at a circumference of the second separated surface, connected between the base and the second separated surface, provided to face the water outlet pipe in an inclined state, and separated from the water outlet pipe.

17. The induction heater of claim 16, wherein the second cover includes a protrusion portion protruding from the base toward the first cover.

18. The induction heater of claim 17, wherein the second cover includes a welding portion formed by welding with the first cover and formed on a protruding surface that protrudes from the base toward the first cover.

19. The induction heater any one of claims 12, 15 and 18, wherein at least one welding portion is formed at each side of the protrusion portion.

20. The induction heater any one of claims 12, 15 and 18, wherein the protrusion portion includes a first portion and a second portion that extend in opposite directions to each other around the welding portion.

21. The induction heater any one of claims 1, 12, 15 and 18, wherein the welding portion has a closed curve shape.

22. The induction heater any one of claims 12, 15 and 18, wherein the induction heater includes a temperature sensor provided at an opposite side to the second cover based on the first cover, and the welding portion is provided to not overlap with the temperature sensor.

23. The induction heater any one of claims 5, 12, 15, and 18, wherein the protrusion portion includes:

a first protrusion portion that extends toward the water inlet pipe and the water outlet pipe; and a second protrusion portion that extends in a direction which crosses an extension direction of the first protrusion portion.

24. The induction heater of claim 7, wherein the first protrusion portion and the second protrusion portion are integrally formed by press processing.

25. The induction heater of claim 7, wherein an extension length of the second protrusion portion is larger than a width of the first protrusion portion.

26. The induction heater of claim 7, wherein the hot water tank assembly includes a plurality of the second protrusion portions, and at least part of the plurality of the second protrusion portions is provided to contact with liquid introduced into the water inlet pipe and liquid to be discharged through the water outlet pipe.

27. The induction heater of claim 23, wherein the first protrusion portion includes a first portion and a second portion extended in opposite directions to each other around the welding portion, and at least one of the second protrusion portion is formed at an end portion of the first portion and an end portion of the second portion, respectively.

28. The induction heater any one of claims 2, 6, 10, and 16, wherein the flow dispersion portion is integrally formed with the base by press processing.

29. The induction heater any one of claims 6, 13 and 16, wherein the flow joining portion is integrally formed with the base by press processing.

30. An induction heater, comprising:

a working coil formed by a conducting wire wound in an annular shape;

a first cover;

a second cover;

a hot water tank assembly formed by coupling edges of the first cover and the second cover to each other, and provided with an inner space to heat liquid, and having a water inlet pipe configured to receive liquid and a water outlet pipe configured to discharge liquid, the first cover formed of a metal material and having a flat plate corresponding to the working coil to be heated by the working coil; and an outer case configured to support the hot water tank assembly, wherein the working coil is mounted on the outer case with the working coil placed between the hot water tank assembly and the outer case, wherein the second cover includes:

a base configured to face the first cover, to be separated from the first cover, and to form the inner space with the first cover; and a protrusion portion protruding from the base toward the first cover, wherein the protrusion portion includes:

a plurality of first protrusions that extend toward the water inlet pipe and the water outlet pipe; and a plurality of second protrusions that extend in a direction that crosses an extension direction of the first protrusion portion, wherein the plurality of first protrusions are spaced apart from the water inlet pipe and the water outlet pipe, and the plurality of first protrusions are spaced apart from each other, and wherein the plurality of second protrusions are spaced apart from the water inlet pipe and the water outlet pipe, and the plurality of second protrusions are spaced apart from each other.

31. The induction heater of claim 30, further comprising a gap spacer formed in a flat plate and provided between the working coil and the hot water tank assembly, wherein two surfaces of the gap spacer are pressurized by coupling the hot water tank assembly and the outer case, and the gap spacer is configured to maintain a constant thickness to constantly maintain a gap between the working coil and the hot water tank assembly.

32. The induction heater of claim 31, wherein the gap spacer is formed in an annular shape corresponding to the working coil, and a temperature sensor is provided in holes of the working coil and the gap spacer to face the hot water tank assembly.

33. The induction heater of claim 31, wherein the gap spacer is formed of a flame-retardant material having a thermal resistance.

34. The induction heater of claim 31, wherein the gap spacer is formed of an electrically insulating material.

35. A water dispenser including the induction heater according to any one of claims 1, 10, 13, 16, and 30.

* * * * *